US011834947B2

(12) United States Patent
Ou et al.

(10) Patent No.: US 11,834,947 B2
(45) Date of Patent: Dec. 5, 2023

(54) 3D IN-SITU CHARACTERIZATION METHOD FOR HETEROGENEITY IN GENERATING AND RESERVING PERFORMANCES OF SHALE

(71) Applicant: Southwest Petroleum University, Chengdu (CN)

(72) Inventors: Chenghua Ou, Chengdu (CN); Chaochun Li, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 121 days.

(21) Appl. No.: 17/489,496

(22) Filed: Sep. 29, 2021

(65) Prior Publication Data

US 2022/0170366 A1 Jun. 2, 2022

(30) Foreign Application Priority Data

Dec. 1, 2020 (CN) ..... 202011393012.7

(51) Int. Cl.
*E21B 49/00* (2006.01)
*E21B 43/30* (2006.01)
*E21B 49/08* (2006.01)

(52) U.S. Cl.
CPC ..... *E21B 49/005* (2013.01); *E21B 43/30* (2013.01); *E21B 49/087* (2013.01); *E21B 2200/20* (2020.05)

(58) Field of Classification Search
CPC ..... E21B 49/005; E21B 43/30; E21B 49/087; E21B 2200/20
See application file for complete search history.

(56) References Cited

U.S. PATENT DOCUMENTS

2011/0108283 A1* 5/2011 Srnka ..... G01V 11/00 702/14
2019/0234856 A1* 8/2019 Ou ..... G01N 33/241
2020/0211126 A1* 7/2020 Hou ..... E21B 49/00

OTHER PUBLICATIONS

Kadkhodaie-Ilkhchi et al., "A committee machine with intelligent systems for estimation of total organic carbon content from petrophysical data: An example from Kangan and Dalan reservoirs in South Pars Gas Field, Iran" 2007 Computers & Geosciences 35 (2009) 459-474 (Year: 2009).*

(Continued)

*Primary Examiner* — Regis J Betsch
(74) *Attorney, Agent, or Firm* — MUNCY, GEISSLER, OLDS & LOWE, P.C.

(57) ABSTRACT

The present invention discloses a three-dimensional in-situ characterization method for heterogeneity in generating and reserving performances of shale. The method includes the following steps: establishing a logging in-situ interpretation model of generating and reserving parameters based on lithofacies-lithofacies-well coupling, and completing single-well interpretation; establishing a 3D seismic in-situ interpretation model of generating and reserving parameters by using well-seismic coupling; establishing a spatial in-situ framework of a layer group based on lithofacies-well-seismic coupling, and establishing a spatial distribution trend framework of small layers of a shale formation by using 3D visualized comparison of a vertical well; and implementing 3D in-situ accurate characterization of shale generating and reserving performance parameters by using lithofacies-well-seismic coupling based on the establishment of the seismic-lithofacies dual-control parameter field. The present invention integrates an in-situ technology into shale logging, seismic generating and reserving parameter interpretation, and the establishment of a 3D mesh model of small layers of shale, which realizes the accurate description (Continued)

of the heterogeneity in TOC content and porosity value of shale oil and gas in a 3D space, and provides a reliable technical support for shale oil and gas exploration and development.

7 Claims, 32 Drawing Sheets

(56) References Cited

OTHER PUBLICATIONS

Ma et al., "Multi-scale 3D characterisation of porosity and organic matter in shales with variable TOC content and thermal maturity: Examples from the Lublin and Baltic Basins, Poland and Lithuania", International Journal of Coal Geology 180 (2017) 100-112 (Year: 2017).*
Sfidari et al., "Comparison of intelligent and statistical clustering approaches to predicting total organic carbon using intelligent systems", Journal of Petroleum Science and Engineering 86-87 (2012) 190-205 (Year: 2012).*
Wang et al., "Revised models for determining TOC in shale play: Example from Devonian Duvernay Shale, Western Canada Sedimentary Basin", Marine and Petroleum Geology 70 (2016) 304e319 (Year: 2016).*

* cited by examiner

| | Ampl | BW | CosPhas | D1 | D2 | DomFreq | Env | Freq | Phase | PhaseShft | Q | RmsAmpl | RelAcImp |
|---|---|---|---|---|---|---|---|---|---|---|---|---|---|
| Ampl | 1.0000 | 0.1822 | 0.7253 | 0.2534 | 0.7867 | 0.1134 | 0.3491 | 0.0505 | 0.0201 | 1.0000 | 0.0505 | 0.3386 | 0.0336 |
| BW | 0.1822 | 1.0000 | 0.1059 | 0.1850 | 0.0091 | 0.6062 | 0.2529 | 0.0457 | 0.0714 | 0.1822 | 0.0457 | 0.0866 | 0.0301 |
| CosPhas | 0.7253 | 0.1059 | 1.0000 | 0.1238 | 0.6302 | 0.0767 | 0.0488 | 0.0350 | 0.0285 | 0.7253 | 0.0350 | 0.0424 | 0.1224 |
| D1 | 0.2534 | 0.1850 | 0.1238 | 1.0000 | 0.0429 | 0.1480 | 0.4826 | 0.0544 | 0.5542 | 0.2534 | 0.0544 | 0.4509 | 0.7669 |
| D2 | 0.7867 | 0.0091 | 0.6302 | 0.0429 | 1.0000 | 0.0461 | 0.0379 | 0.0124 | 0.1268 | 0.7867 | 0.0124 | 0.1004 | 0.2193 |
| DomFreq | 0.1134 | 0.6062 | 0.0767 | 0.1480 | 0.0461 | 1.0000 | 0.3587 | 0.8000 | 0.0692 | 0.1134 | 0.8000 | 0.2452 | 0.0285 |
| Env | 0.3491 | 0.2529 | 0.0488 | 0.4826 | 0.0379 | 0.3587 | 1.0000 | 0.2503 | 0.1417 | 0.3491 | 0.2503 | 0.9661 | 0.4858 |
| Freq | 0.0505 | 0.0457 | 0.0350 | 0.0544 | 0.0124 | 0.8000 | 0.2503 | 1.0000 | 0.0233 | 0.0505 | 1.0000 | 0.2254 | 0.0381 |
| Phase | 0.0201 | 0.0714 | 0.0285 | 0.5542 | 0.0127 | 0.0692 | 0.1417 | 0.0233 | 1.0000 | 0.0201 | 0.0233 | 0.1355 | 0.4823 |
| PhaseShft | 1.0000 | 0.1822 | 0.7253 | 0.2534 | 0.7867 | 0.1134 | 0.3491 | 0.0505 | 0.0201 | 1.0000 | 0.0505 | 0.3386 | 0.0336 |
| Q | 0.0505 | 0.0457 | 0.0350 | 0.0544 | 0.0124 | 0.8000 | 0.2503 | 1.0000 | 0.0233 | 0.0505 | 1.0000 | 0.2254 | 0.0381 |
| RmsAmpl | 0.3386 | 0.0866 | 0.0424 | 0.4509 | 0.1004 | 0.2452 | 0.9661 | 0.2254 | 0.1355 | 0.3386 | 0.2254 | 1.0000 | 0.4944 |
| RelAcImp | 0.0336 | 0.0301 | 0.1224 | 0.7669 | 0.2193 | 0.0285 | 0.4858 | 0.0381 | 0.4823 | 0.0336 | 0.0381 | 0.4944 | 1.0000 |
| Total | 1.0000 | 0.0000 | 0.0000 | 0.0000 | 0.0000 | 0.0000 | 0.0000 | 0.0000 | 0.0000 | 1.0000 | 0.0000 | 0.0000 | 0.0000 |

FIG. 40

3D IN-SITU CHARACTERIZATION METHOD FOR HETEROGENEITY IN GENERATING AND RESERVING PERFORMANCES OF SHALE

TECHNICAL FIELD

The present invention relates to the field of shale oil and gas exploration and development, in particular to a 3D in-situ characterization method for heterogeneity in generating and reserving performances of shale.

BACKGROUND ART

In a shale formation, the amount of generated and reserved oil/gas may be expressed by the TOC content in the shale formation, and the amount of free oil/gas may be expressed with the porosity. The TOC content and porosity, which are important generating and reserving performance parameters for shale oil and gas, as well as two key parameters necessary for the calculation of shale oil/gas reserves, determine the generating and reserving amount and scale of shale oil and gas, and thus become key parameters that must be implemented in the shale oil and gas exploration and development process. How to accurately describe the heterogeneity in shale oil and gas generating and reserving performance parameters in a 3D space is a technical problem that must be solved in shale oil and gas production.

Shale oil and gas have the following typical characteristics and key technical problems: (1) a plane of sedimentary microfacies changes little, but vertical sedimentary microfacies change frequently, and different types of microfacies will cause different lithofacies properties due to differences in sedimentary environments, accomplished with different pore and fracture structures due to historical evolution of diagenesis, so different lithofacies properties and pore and fracture structures will inevitably produce different lithofacies types; on the contrary, different lithofacies types will show different characteristics of heterogeneous changes in shale generating and reserving performances; (2) the reservoir has poor physical properties and low matrix permeability; the air permeability is usually less than or equal to 0.2 mD; the porosity is usually less than 8%; the heterogeneity in lithology, physical properties and gas-oil properties is extremely strong, which will surely bring about strong heterogeneity in shale generating and reserving performances; (3) geology, logging and earthquake are the three major data sources that characterize the characteristics of lithofacies mechanics and in-situ stress; indoor geological analysis focuses on establishing micro-scale cognition and geological body models; a logging interpretation and analysis system characterizes the changes in vertical meter-scale geological bodies; the seismic interpretation analysis fully reflects the changes in horizontal and planar ten-meter-scale geological bodies; how to realize the organic coupling of geology, logging and earthquake in order to effectively characterize the in-situ characteristics of tight oil and gas in a 3D space, such as shale oil and gas, tight sandstone oil and gas, and tight carbonate oil and gas, is one of the key technical problems to be solved urgently; and (4) an ultra-long horizontal well+multi-stage re-fracturing supporting technology is a main technology for developing tight oil and gas such as shale oil and gas, tight sandstone oil and gas, and tight carbonate oil and gas; fewer vertical wells and more horizontal wells are the actual situations faced by the development zone; and how to fully integrate the respective advantages of vertical and horizontal wells and accurately characterize a spatial in-situ position of each small layer of a microfacies lithofacies is another key technical problem to be solved urgently.

The TOC content and porosity values in the shale formation are mostly derived from logging interpretation, or obtained through seismic interpretation. Then, a 3D model of TOC content and porosity is established by using a deterministic modeling algorithm, a stochastic modeling algorithm or the like, thereby achieving the description of the 3D distribution characteristics of the TOC content and the porosity. Most of the existing logging interpretation models for TOC content and porosity value are directly derived from the fitting of core data and logging data, but there is a lack of a big data mining process between the core data and the logging data. In the process of logging interpretation, there is also a lack of using lithofacies types to control and restrict interpretation parameters, resulting in large errors between the logging interpretation results and the actual TOC content and porosity values of the shale formation. At the same time, shale oil and gas development zones are generally dominated by horizontal wells and few vertical wells, so a 3D stratigraphic framework established mainly using hierarchical data of a vertical well often cannot truly reflect the spatial extension characteristics of a horizontal section trajectory of a horizontal well.

The authorized invention patent "Method for Structural Modeling Based on 3D Visual Stratigraphic Correlation of Horizontal Well" (Application date: Aug. 18, 2015, Inventors: Ou Chenghua, Xu Yuan, Li Chaochun; Patent number: ZL2015 1 0508165.4) provides a method for structural modeling based on 3D visual stratigraphic correlation of a horizontal well. However, this method neither involves separately establishing a spatial in-situ framework of a layer group and a small-layer framework within the layer group based on well electrical lithofacies-electric facies of vertical well-seismic coupling, nor does it propose the use of a multi-mesh approximation algorithm under the condition of ensuring zero residual so as to complete structural distribution models of the top and bottom surfaces of the layer group and the top and bottom surfaces of the small layers respectively.

It can be seen that a new technical method needs to be proposed to ensure the authenticity and reliability of the TOC content and porosity value in the logging interpretation, and at the same time realize the true reproduction of the heterogeneous characteristics of the TOC content and porosity value in a 3D space of a horizontal well trajectory.

SUMMARY OF THE INVENTION

The present invention aims to overcome the defects of the prior art, and provide a 3D in-situ characterization method for heterogeneity in generating and reserving performances of shale.

The objective of the present invention is achieved by the following technical solution.

A three-dimensional in-situ characterization method for heterogeneity in generating and reserving performances of shale, comprising the following steps:

S1: establishing a logging in-situ interpretation model of generating and reserving parameters based on lithofacies-lithofacies-well coupling, and completing point-by-point interpretation of generating and reserving parameters of a single well;

S2: establishing an optimal well-seismic coupling interpretation model that characterizes the TOC content and porosity of a shale formation based on well-seismic coupling;

S3: completing the establishment of a structural distribution model of top and bottom surfaces of a layer group based on lithofacies-electrical facies of vertical well-seismic coupling, thereby forming an in-situ spatial framework of the layer group;

S4: establishing a structural distribution model of top and bottom surfaces of small layers based on a vertical well by using 3D visualization comparison of the vertical well, thereby forming a spatial distribution trend framework of small layers of the shale formation;

S5: establishing a structural distribution model of top and bottom surfaces of small layers based on vertical well+horizontal well by using 3D visualization comparison of the horizontal well, thereby forming an in-situ three-dimensional mesh model of the small layers of the shale formation;

S6: establishing a three-dimensional model and a lithofacies model of seismic attributes of in-situ TOC content and porosity of the shale formation, thereby forming a three-dimensional visualized seismic-lithofacies dual-control parameter field of generating and reserving performance parameters of shale; and S7: coarsening single-well point-by-point data of the TOC content and porosity completed on the basis of lithofacies-lithofacies-well coupling into an in-situ three-dimensional mesh model of the small layers of shale, to form a main input of three-dimensional visualization modeling; coupling the seismic-lithofacies dual-control parameter field to the logging TOC and porosity by taking TOC and porosity statistics of various lithofacies in a three-dimensional space of a lithofacies model as constraints, taking a three-dimensional model of seismic attributes of the TOC content and porosity as a changing trend, and using a simulation method of combining sequential Gaussian with co-kriging, thereby realizing the three-dimensional in-situ characterization of the spatial heterogeneity characteristics of the TOC content and porosity of shale.

Further, the S1 specifically comprises the following sub-steps:

S101: returning the TOC and porosity value obtained by a core test to an in-situ drilling depth by core location, extracting curve values of conventional logging series at the same depth, mining a relationship between the TOC and the conventional logging series and a relationship between the porosity and the conventional logging series by using a classification regression tree algorithm, and determining a sensitive logging curve for the TOC and the porosity;

S102: establishing a TOC and porosity calculation model for the sensitive logging curve by using a multiple regression method, and completing single-well point-by-point calculation of the TOC and the porosity; counting the TOC and the porosity value of each type of shale lithofacies by using a shale lithofacies mode established on the basis of core descriptions; extracting the statistics of the TOC and porosity value of each type of shale lithofacies, establishing a TOC and porosity calculation model by merging the statistics, and forming a logging interpretation model for generating and reserving performance parameters of shale; and S103: based on the statistics of the TOC and porosity value of each type of shale lithofacies, correcting and perfecting single-well point-by-point calculation results of the TOC and porosity value on the basis of single-well lithofacies analysis results, to complete the single-well point-by-point interpretation of the TOC and porosity value.

Further, the sensitive logging curves for the TOC and porosity include a natural gamma GR logging curve, a sonic time difference AC logging curve, a compensated neutron CNL logging curve, a compensated density DEN logging curve and a deep lateral resistivity RT logging curve.

Further, the S2 specifically comprises the following sub-steps:

S201: extracting 3D seismic body attributes from modeling software;

S202: preliminarily screening seismic body attribute types that can be used to express the TOC content and porosity of a shale formation according to an original geological meaning of seismic body attributes, judging the independence of the screened seismic body attributes by using a R-type factor analysis method, and eliminating the seismic body attributes with high correlation to obtain preferred seismic body attributes that express the TOC content and porosity value of the shale formation; and S203: establishing an optimal well-seismic coupling interpretation model that characterizes the TOC content and porosity of the shale formation by using well-seismic coupling and adopting a single attribute linear regression method, a multi-attribute nested combination analysis method and a self-feedback neural network method respectively.

Further, the S3 specifically comprises the following sub-steps:

S301: establishing an in-situ layering model of lithofacies-electrical facies coupling for top and bottom surfaces of a layer group and an interface of each small layer in the layer group based on lithofacies characteristics of a vertical well under exploration evaluation, and characteristics of a lithology indicator curve, a porosity indicator curve, or an oil-gas-bearing indicator curve, to form an in-situ spatial framework of the top and bottom surfaces of the layer group and interfaces of the small layers in the layer group at the location of a drilling well point;

S302: establishing a time-depth conversion relationship by using a synthetic recording method, and projecting in-situ depth information of the top and bottom surfaces of the layer group identified by the vertical well under exploration evaluation onto a seismic-time profile to form a well-seismic coupling relationship of top and bottom interfaces of a main oil-producing layer group of the shale formation; and S303: converting time data of the top and bottom surfaces of the layer group into depth data by using the established time-depth conversion relationship; completing the establishment of a structural distribution model of the top and bottom surfaces of the layer group under the condition of ensuring that a residual at the vertical well point under exploration evaluation is zero by means of a multiple mesh approximation algorithm by using the depth data as a main input, and elevation data of the vertical well point under exploration evaluation as a hard constraint condition, and forming a spatial in-situ framework of the layer group of the shale formation.

Further, the S4 comprises the following sub-steps:

S401: carrying out three-dimensional visualized comparison of small layers of the vertical well according to an in-situ layering mode of lithofacies-electric facies coupling for interfaces of respective small layers in the layer group, extracting the elevation data of the top and bottom surfaces of the small layers at each vertical well position, and establishing a small layer framework in the layer group; and S402: establishing a structural distribution model of the top and bottom surfaces of small layers according to a position proximity principle by selecting a structural distribution model of top and bottom surfaces of the layer group close to the top and bottom surfaces of the small layers as a main input, and the elevation data of the top and bottom surfaces of each small layer as a hard constraint by means of a multiple mesh approximation principle under the condition of ensuring that the residual at the vertical well point is zero, and forming a spatial distribution trend framework of the small layers of the shale formation.

Further, the S5 specifically comprises the following sub-steps:

S501: carrying out three-dimensional visualized comparison of a horizontal well according to an in-situ layering mode of lithofacies-electric facies coupling of interfaces of respective small layers in the layer group, and determining a relationship between a horizontal well trajectory and top and bottom interfaces of a target small layer; and S502: quantitatively characterizing the target small layer along the horizontal well trajectory and the top and bottom interface positions of each small layer adjacent to the target small layer, extracting position elevation data to form elevation data of the top and bottom surfaces of the small layers of the horizontal well, and merging the elevation data with the elevation data of the top and bottom surfaces of the small layer at the vertical well position into a new data set; and establishing a new structural distribution model of top and bottom surfaces of small layers based on vertical well+horizontal well by using the previously established structural distribution model of the top and bottom surfaces of the small layers as a trend constraint, to finally form an in-situ three-dimensional mesh model of the small layers of shale.

Further, the S6 comprises the following sub-steps:

S601: assigning parameters of the TOC content and porosity 3D model, which are predicted by seismic attributes, into the in-situ 3D mesh model of the small layers of shale respectively by using a deterministic assignment method, and establishing a three-dimensional model of the seismic attributes of the in-situ TOC content and porosity of the shale formation; and S602: establishing a lithofacies model with result data of single-entry lithofacies analysis as a main input according to a principle sequential indicator or truncated Gaussian method, and forming a seismic-lithofacies dual-control parameter field with three-dimensional visualization of the TOC content and porosity of shale.

The present invention has the following beneficial effects: by integrating an in-situ technology into shale logging, seismic generating and reserving parameter interpretation, and the establishment of a 3D mesh model of small layers of shale, a supporting technical method for in-situ interpretation of shale generating and reserving performance parameters-shale small-layer framework spatial in-situ modeling-in-situ 3D visualized description of heterogeneity in shale generating and reserving performance parameters is established, which realizes the accurate description of the heterogeneity in TOC content and porosity value of shale oil and gas in a 3D space, and provides a reliable technical support for shale oil and gas exploration and development.

BRIEF DESCRIPTION OF THE DRAWINGS

FIG. 40 is a table of correlation analysis of seismic body attributes of a shale gas field in an example.

DETAILED DESCRIPTION

In order to have a clearer understanding of the technical features, objectives and effects of the present invention, specific embodiments of the present invention will now be described with reference to the accompanying drawings.

Figure 1:
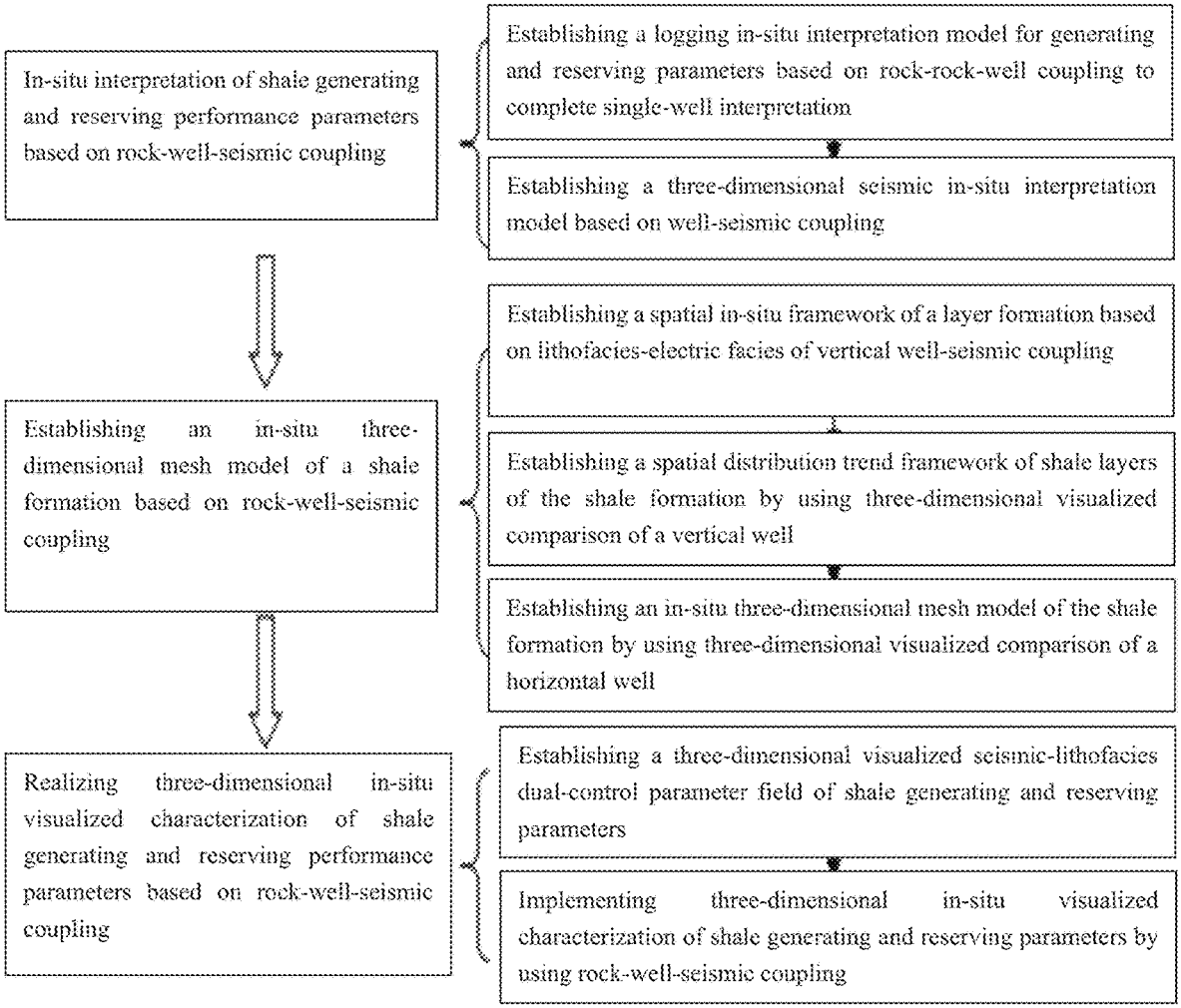
FIG. 1 is a flowchart of a method of the present invention.

In this embodiment, as shown in FIG. 1, an in-situ technology has been integrated into shale logging, interpretation of seismic generating and reserving parameters, and establishment of 3D mesh models of small layers of shale in view of the common characteristics of shale oil and gas. An in-situ logging interpretation model for generating and reserving parameters is established based on lithofacies-lithofacies-well coupling of core, lithofacies and logging, thereby completing single-well interpretation. A 3D seismic in-situ interpretation model of generating and reserving parameters is established by using well-seismic coupling. An in-situ spatial framework of a layer group is established based on lithofacies-electrical facies of vertical well-seismic coupling, a spatial distribution trend framework of small layers of a shale formation is established by using 3D visualization comparison of the vertical well, and an in-situ 3D mesh model of the small layers of shale is established by using 3D visualization comparison of a horizontal well. Based on the establishment of a 3D visualized seismic-lithofacies dual-control parameter field of shale generating and reserving performance parameters, accurate 3D in-situ characterization of shale generating and reserving performance parameters is realized by using lithofacies-well-seismic coupling, thereby achieving the accurate description of the heterogeneity in TOC content and porosity value of shale oil and gas in a 3D space.

(1) In-situ interpretation of the shale generating and reserving performance parameters based on lithofacies-well-seismic coupling.

S101: establishing a logging in-situ interpretation model of generating and reserving performance parameters based on core, lithofacies and logging coupling, and completing point-by-point interpretation of generating and reserving parameters of a single well; returning TOC and porosity values obtained by a core test to an in-situ drilling depth by using core location, extracting curve values of conventional logging series at the same depth, mining a relationship between the TOC and the conventional logging series and a relationship between the porosity and the conventional logging series by using a classification regression tree algorithm, and determining sensitive logging curves for the TOC and the porosity; establishing a TOC and porosity calculation model for the sensitive logging curves by using a multiple regression method, and completing single-well point-by-point calculation of the TOC and the porosity; counting the TOC and the porosity value of each type of shale lithofacies by using a shale lithofacies model established based on core descriptions; extracting the statistics of the TOC and porosity value of each type of shale lithofacies, establishing a TOC and porosity calculation model by merging the statistics, and forming a logging interpretation model for shale generating and reserving parameters; and based on the statistics of the TOC and porosity value of each type of shale lithofacies, correcting and perfecting single-well point-by-point calculation results of the TOC and porosity value on the basis of single-well lithofacies analysis results, to complete the single-well point-by-point interpretation of the TOC and porosity values.

Figure 2:
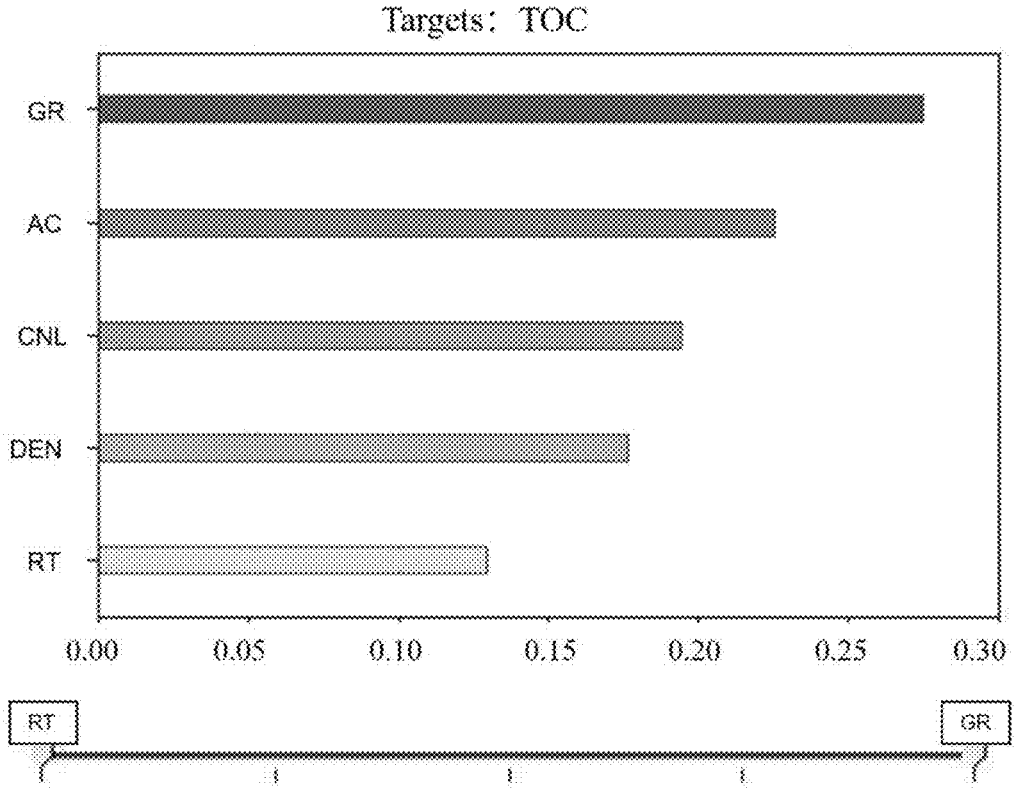
FIG. 2 shows screening results of a conventional logging curve that is sensitive to TOC by using a classification and regression tree algorithm in the shale gas field in an example.
Figure 3:
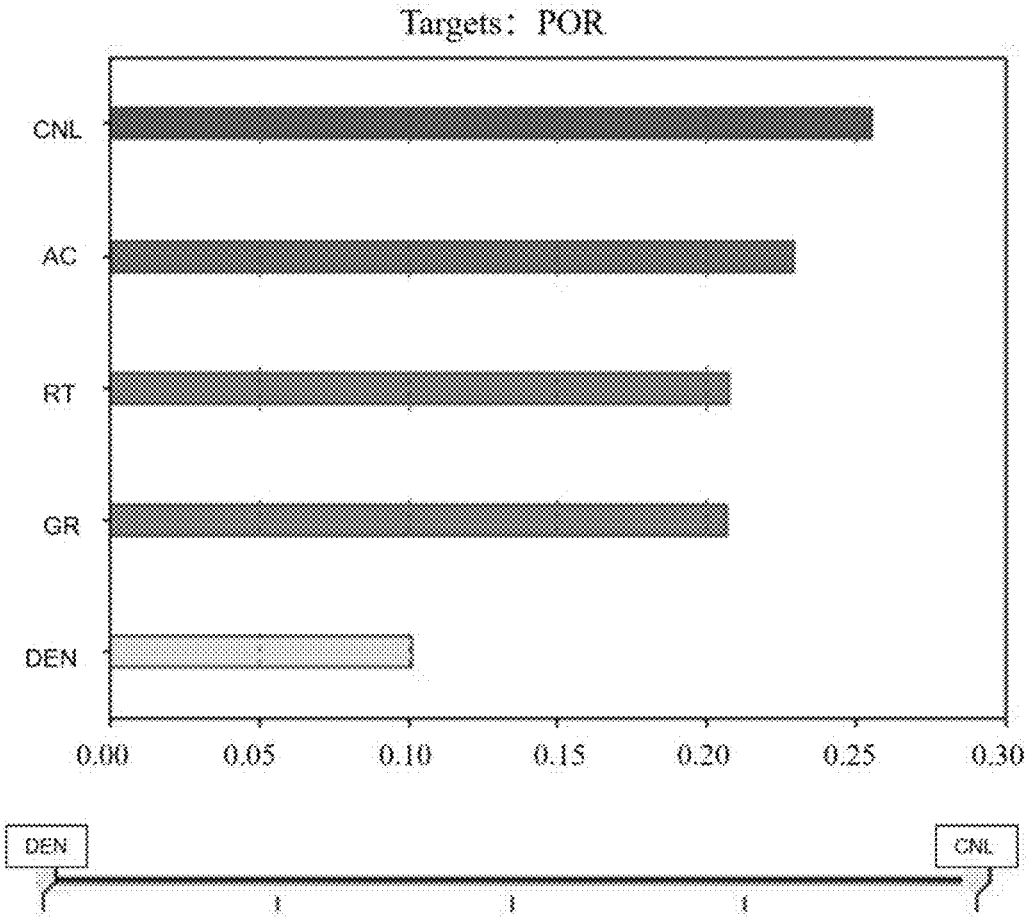
FIG. 3 shows screening results of a conventional logging curve that is sensitive to porosity by using a classification and regression tree algorithm in the shale gas field in an example.

As shown in FIG. 2 and FIG. 3, the TOC and porosity values of a shale gas field in a western area of China obtained by core testing, and conventional logging curve values extracted at the same depth as core location are given. A relationship between the TOC and conventional logging series and a relationship between the porosity and the conventional logging series are mined by using a classification regression tree algorithm. The determined logging curves that are sensitive to the TOC and porosity include natural gamma GR, sonic time difference AC, compensated neutron CNL, compensated density DEN, and deep lateral resistivity RT.

Figure 4:
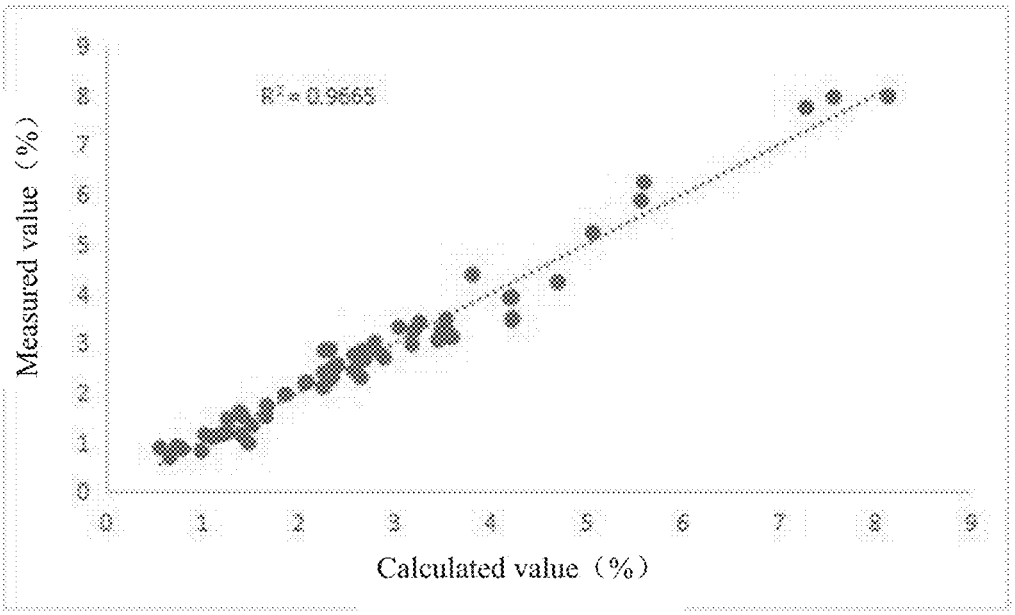
FIG. 4 is a diagram showing a relationship between calculated values and measured values of a multiple regression TOC calculation model of the shale gas field in an example.
Figure 5:
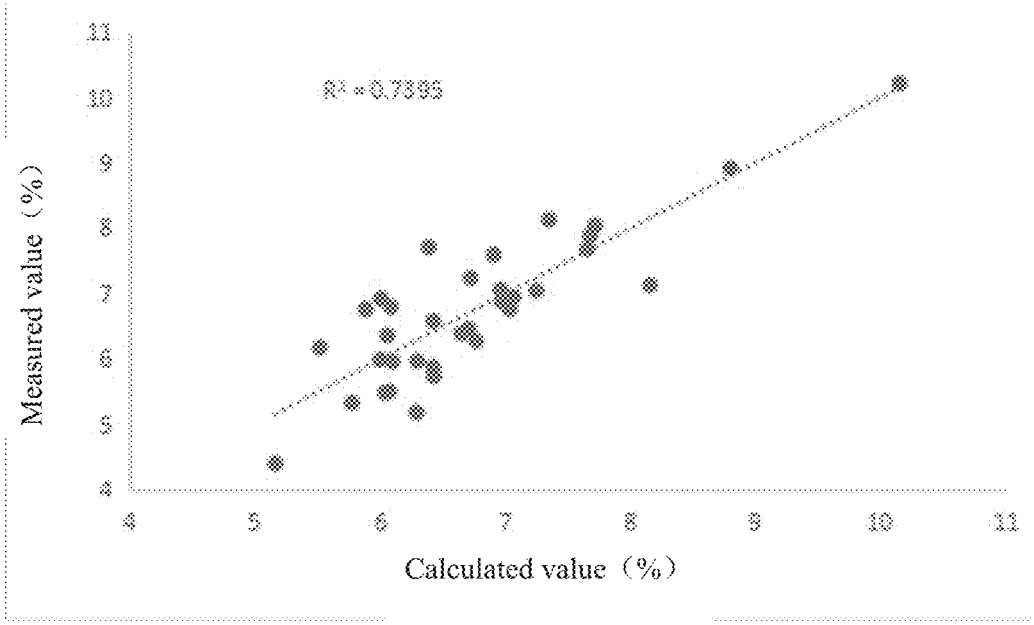
FIG. 5 is a diagram showing a relationship between calculated values and measured values of a multiple regression porosity calculation model of the shale gas field in an example.

Formula (1) and Formula (2) are logging calculation models of the TOC and porosity established respectively by a multiple regression method. As shown in FIG. 4, a correlation coefficient R2 between a measured value of the TOC calculation model and a calculated value of the model can reach 0.9665. As shown in FIG. 5, a correlation coefficient $R^2$ between a measured value of the porosity calculation model and a calculated value of the model can reach 0.7395, which has higher precision than the conventional calculation models that predict the TOC and the porosity value by using single conventional logging curves.

$$TOC=0.0331GR+0.00414AC-0.1746CNL-3.524DEN+0.000038RT+8.8606 \quad (1)$$

$$POR=0.5753CNL-0.1079AC+0.004039RT-0.0055GR-9.8596DEN+33.345 \quad (2)$$

in which, TOC and POR represent total organic carbon content and porosity, %; R1 represents deep lateral resistivity, Ω·m; AC represents sonic time difference, μs/ft; CNL represents compensated neutron, %; DEN represents compensated density, g/cm$^3$; GR represents natural gamma, API.

Table 1 shows 9 types of shale lithofacies identified based on core descriptions, as well as the maximum, minimum and average values of TOC and porosity of each type of shale lithofacies obtained by statistics in a shale gas field in a western area of China. The calculated maximum, minimum, and average values of TOC and porosity are combined with the established TOC and porosity calculation models (Formulas 1 and 2), which together form a lithofacies-well coupling shale TOC and porosity logging interpretation model.

TABLE 1

Various lithofacies and their TOC and porosity statistics identified by core descriptions in a shale gas field in a western area of China

| Lithofacies code | Lithofacies type | TOC content (%) | Porosity (%) |
|---|---|---|---|
| a | Carbon-rich and high-porosity calcium-containing argillaceous siliceous shale | 3.48-11.38/5.67 | 4.91-7.29/5.93 |
| b | Carbon-rich and porosity-rich mixed shale | 3.62-9.19/5.48 | 5.52-11.18/8.20 |
| c | High-carbon and medium-high-porosity, calcium-containing argillaceous siliceous shale | 2.52-4.58/3.41 | 3.61-7.56/6.10 |
| d | High-carbon and medium-high-porosity mixed shale | 2.85-4.15/3.91 | 2.19-10.85/6.99 |
| e | Medium-carbon and medium-porosity argillaceous silty shale | 1.85-3.56/2.52 | 2.01-5.22/3.69 |
| f | Medium-high-carbon and medium-high-porosity calcium-containing argillaceous silty shale | 1.63-4.31/2.63 | 3.81-8.04/6.19 |
| g | Medium-carbon and medium-high-porosity mixed shale | 1.78-5.03/2.53 | 3.27-9.04/6.65 |
| h | Low-carbon and low-porosity argillaceous silty shale | 1.03-3.61/1.71 | 1.64-2.84/2.14 |
| i | Low-carbon and medium-low-orosity mixed shale | 0-6.192.01 | 1.22-5.81/4.19 |

Figure 6:
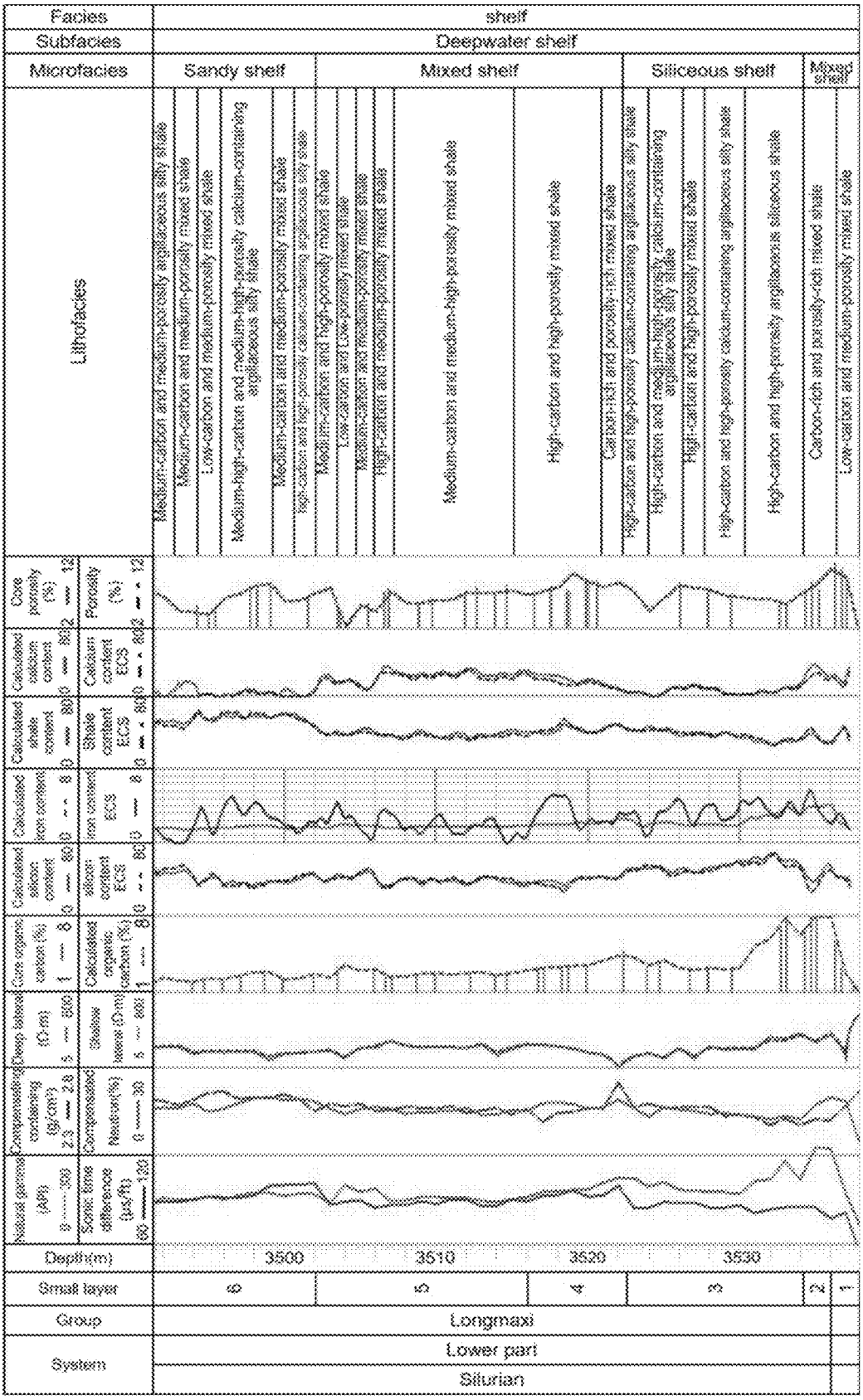
FIG. 6 shows TOC and porosity interpretation results of a single well in the shale gas field based on the completion of a lithofacies-well coupled logging interpretation model in an example.

By using the Formulas 1 and 2, point-by-point calculation of the TOC and porosity values of the shale gas field are completed by using the natural gamma GR, sonic time difference AC, compensated neutron CNL, compensated density DEN and deep lateral resistivity RT acquired and recorded from a shale gas field in western of China. On this basis, the point-by-point calculation results of the TOC and porosity values of each single well are corrected and completed based on the identification of 9 types of 3D shale lithofacies, as well as the TOC and porosity value statistics of each type of shale lithofacies in a shale gas field in western of China, according to the results of single-well lithofacies analysis, to finally obtain point-by-point interpretation results of the TOC and porosity values of each single well in a research zone, as shown in FIG. 6. Through the lithofacies-well coupling method proposed by the present invention, the single-well TOC and porosity values obtained by interpretation are closer to in-situ characteristics of a shale reservoir than traditional logging interpretation results, and the reliability and accuracy are also higher.

S2: establishing a 3D seismic in-situ interpretation model of generating and reserving parameters of shale based on well-seismic coupling; completing 3D seismic body attribute extraction by using modeling software; preliminarily screening seismic body attribute types that can be used to express the TOC content and porosity of a shale formation according to an original geological meaning of seismic body attributes, judging the independence of the screened seismic body attributes by using a R-type factor analysis method, and eliminating the seismic body attributes with high correlation to obtain preferred seismic body attributes that express the TOC content and porosity of the shale formation; and establishing a 3D in-situ interpretation model of generating and reserving parameters of shale by using well-seismic coupling and by adopting a single-attribute linear regression method, a multi-attribute nested combination analysis method and a self-feedback neural network method respectively.

The single-attribute linear regression method is the simplest method to establish a coupling relationship between the logging interpretation of TOC content & porosity and seismic body attributes. Assuming a linear correlation therebetween, a correlation coefficient is used to determine the strength of the correlation, and data is tested for significance. The mathematical principle of this method is:

$$P(x,y,z)=aA_n(x,y,z)+b \quad (1)$$

in which: P represents logging interpretation TOC content or porosity, which is a function of coordinates x, y, z; An represents an $n^{th}$ seismic attribute; and a, b represent related parameters.

The multi-attribute nested combination analysis method is to combine attributes with high linear regression correlation, and take one extracted attribute as input to obtain a functional relationship between these attribute combinations and the TOC content and porosity to be explained. When combining, it is necessary to consider the geological meaning and change trend of seismic attributes, and avoid attribute combinations with large differences in geological meaning or change trends. The mathematical principle of this method is:

$$P(x,y,z)=F[A_n(x,y,z)] \quad (2)$$

in which: F represents a functional relationship; An represents an $n^{th}$ seismic attribute; and P represents logging interpretation TOC content or porosity, which is a function of coordinates x, y, z.

The multi-attribute self-feedback neural network method realizes the nonlinear coupling between the logging interpretation of TOC content and porosity and seismic body attributes by using a three-layer network structure of an input layer, a hidden layer, and an output layer, so that the logging interpretation information of TOC content or porosity is used to convert the 3D seismic attributes into the TOC content or porosity through a self-feedback neural network. During the operation of the multi-attribute self-feedback neural network method, if an input mode P is added to the input layer, and it is supposed that a sum of the inputs of a $j^{th}$ unit of a $k^{th}$ layer is, an output is, a combined weight from an $i^{th}$ neuron in a $(k-1)^{th}$ layer to a $j^{th}$ neuron in the $k^{th}$ layer is, and an input and output relationship function of each neuron is f, a relationship between respective variables is:

$$V_i^k=f(u_j^k) \quad (3)$$

$$u_j^k=\Sigma W_{ij}^{k-1}V_i^{k-1} \quad (4)$$

This algorithm learning process is composed of forward and backward propagation processes. During the forward propagation, an input model is processed layer by layer from the input layer through the hidden layer, and then passed to the output layer. The state of each layer of neurons only affects the state of the next layer of neurons. If a desired result is not obtained in the output layer, the forward propagation will turn to back propagation and returns from the output layer such that an error signal returns along ab original connecting path, and the error signal is minimized by modifying the weight of each neuron.

Figure 7:
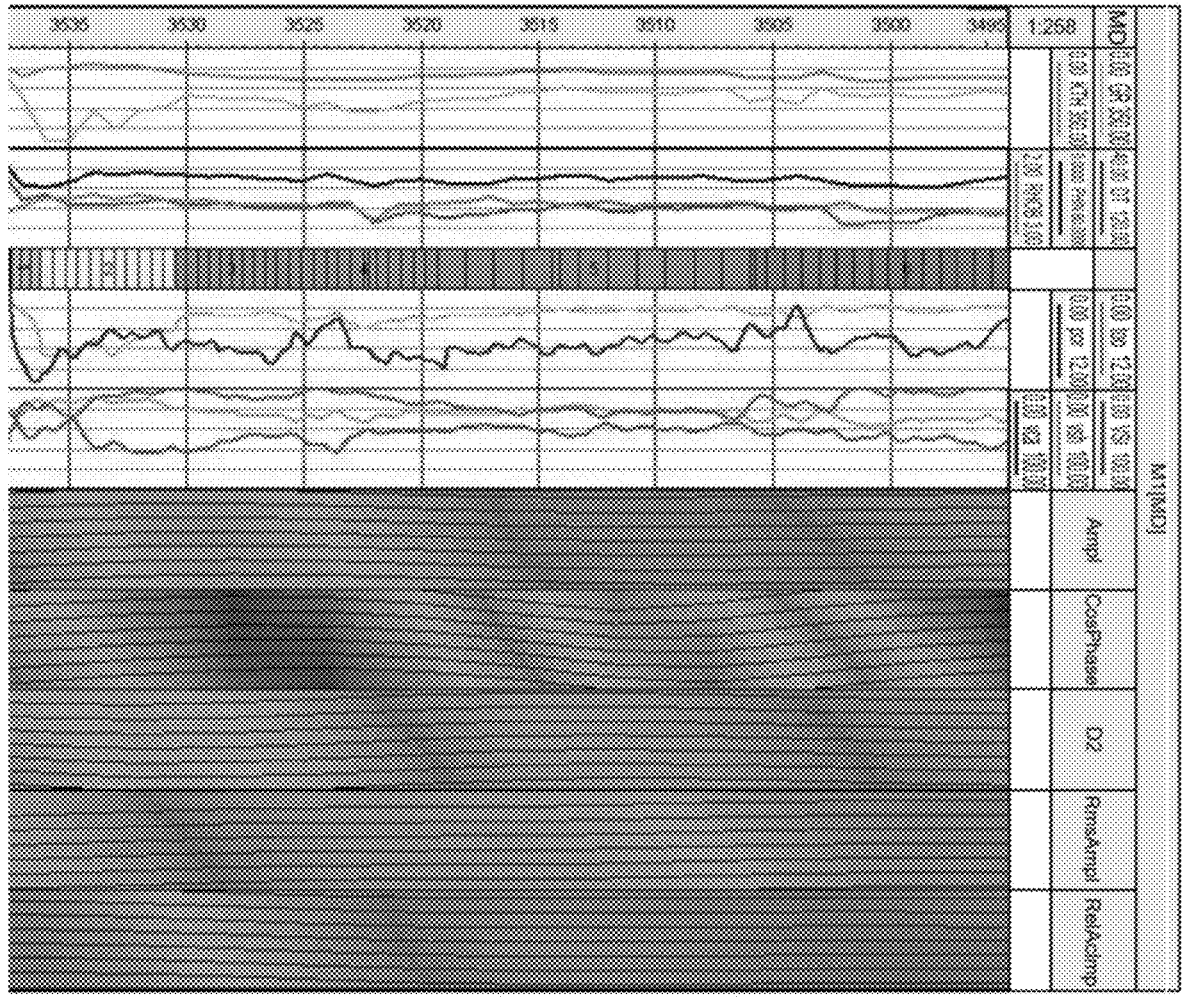
FIG. 7 is a histogram of the coupling of seismic attributes and logging curves of a well M1 in the shale gas field in an example.
Figure 8:
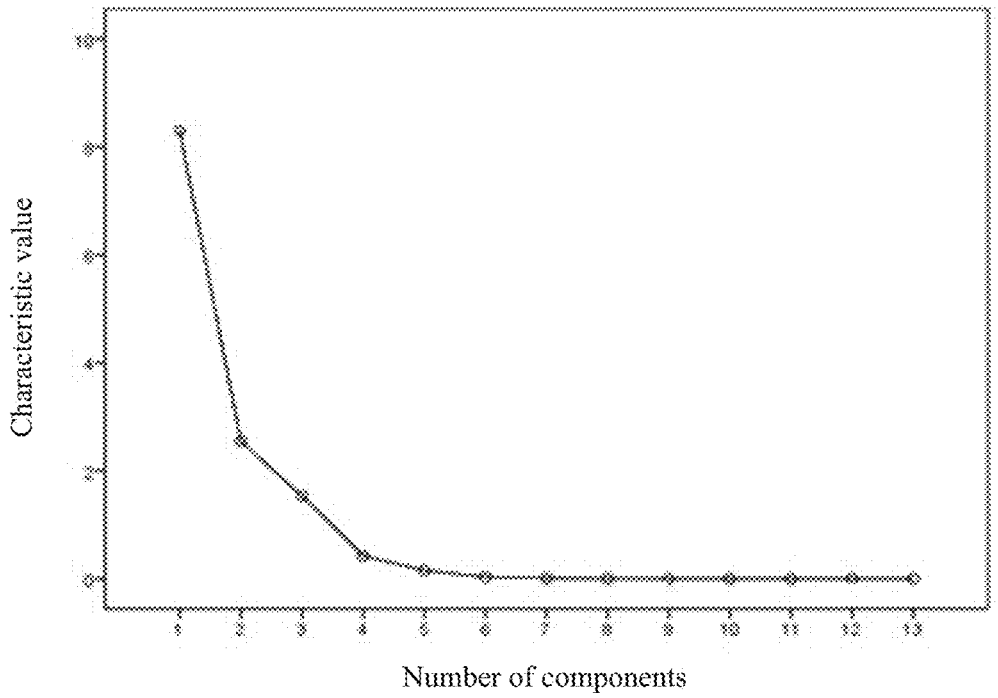
FIG. 8 is a scree plot of R-type factor analysis on seismic body attributes of the shale gas field in an example.

As shown in FIG. 7, scree plot (FIG. 8) analysis is performed on 13 seismic attributes extracted from a shale gas field in western of China by using an R-type factor analysis method. It can be seen that when the number of components exceeds 4, a characteristic value starts to be less than 1; and when the number of components is 3, a characteristic value is greater than 1. That is, these 13 seismic attributes can be classified into three categories (see Table 2). According to a calculated cumulative contribution rate of the variances of respective factors, when three factors are extracted, the cumulative variance contribution rate can reach 95.269%, that is, the information on 95.269% of original 13 seismic attributes can be reflected. According to the correlation analysis between attributes (as shown in FIG. 40), it can be concluded that the attributes Ampl and PhaseShft, and the attributes Freq and Q that belong to Category I are highly correlated; the attributes Env and RmsAmpl, which belong to Category II, are also almost completely correlated, and only one of the commonly used ones needs to be reserved. Therefore, excluding the attributes PhaseShft, Q, and Env, the original 13 types of single seismic body attributes are left with 10 types (Table 4). At the same time, the attribute Ampl is still highly correlated with attributes CosPhase and D2, attributes BW and DomFreq, attributes CosPhase and D2, attributes D1 and RelAcImp, and attributes DomFreq and Freq. After analyzing their geological meanings and comparing the law of curve changes, it is believed that attribute combinations can be carried out to generate 7 combinations of attributes. Therefore, after independent analysis of the seismic body attributes of a shale gas field in western of China, 10 single seismic body attributes, and 7 combined seismic body attributes, i.e., a total of 17 seismic body attributes are selected preferably (see Table 4).

TABLE 2

Seismic body attributes and their factor analysis rotation component matrixs (classified) of a shale gas field in western of China

| | Category I | Category II | Category III |
|---|---|---|---|
| Ampl | 0.899 | | |
| BW | | | 0.881 |
| CosPhase | 0.986 | | |
| D1 | | | −0.932 |
| D2 | −0.840 | | |
| DomFreq | 0.886 | | |
| Env | | 0.818 | |
| Freq | 0.893 | | |
| Phase | | | 0.897 |
| PhaseShft | −0.899 | | |
| Q | 0.893 | | |
| RmsAmpl | | 0.953 | |
| RelACImp | | −0.783 | |

TABLE 4

Seismic body attributes selected by the R-type factor analysis method in a shale gas field in western of China

| Single attribute | Combined attribute |
|---|---|
| Ampl (instantaneous amplitude) | AMPL + COSPHASE (instantaneous amplitude + phase cosine) |
| BW (instantaneous bandwidth) | Ampl + D2 (instantaneous amplitude + second derivative) |
| CosPhase (phase cosine) | Ampl + CosPhase + D2 (instantaneous amplitude + cosine phase + second derivative) |
| D1 (first derivative) | BW + DomFreq (instantaneous bandwidth + main frequency) |
| D2 (second derivative) | CosPhase + D2 (phase cosine + second derivative) |
| DomFreq (main | D1 + RelAcImp (first derivative + |

TABLE 4-continued

| Seismic body attributes selected by the R-type factor analysis method in a shale gas field in western of China | |
|---|---|
| Single attribute | Combined attribute |
| frequency) | relative acoustic impedance) |
| Freq (instantaneous frequency) | DomFreq + Freq (main frequency + instantaneous frequency) |
| Phase (instantaneous phase) | |
| RelAcImp (relative acoustic impedance) | |
| RmsAmpl (root mean square amplitude) | |

The results of a TOC content and porosity interpretation model of the shale gas field in western of China, which is established based on the well-seismic coupling single-attribute linear regression method is as follows: Table 5 and Table 6 are correlation and significance test tables between the logging TOC content and porosity calculated by the single-attribute linear regression method and the preferably selected 10 seismic attributes respectively; and the results show that, except for the slightly high correlation coefficients with RelACImp and RmsAmpl, the TOC content has no correlation with other seismic body attributes, and the porosity has almost no seismic body attributes related thereto.

TABLE 5

| List of coupling correlations between the logging TOC content and seismic attributes of a shale gas field in western of China based on a single attribute linear regression method | | |
|---|---|---|
| | | TOC |
| Ampl | Relevance | 0.240 |
| | Significance | 0.000 |
| BW | Relevance | 0.003 |
| | Significance | 0.076 |
| CosPhase | Relevance | 0.044 |
| | Significance | 0.000 |
| D1 | Relevance | 0.134 |
| | Significance | 0.000 |
| D2 | Relevance | 0.296 |
| | Significance | 0.000 |
| DomFreq | Relevance | 0.253 |
| | Significance | 0.000 |
| Freq | Relevance | 0.281 |
| | Significance | 0.000 |
| Phase | Relevance | 0.038 |
| | Significance | 0.000 |
| RelACImp | Relevance | 0.582 |
| | Significance | 0.000 |
| RmsAmpl | Relevance | 0.569 |
| | Significance | 0.000 |

TABLE 6

| List of coupling correlations between the logging TOC content and seismic attributes of a shale gas field in western of China based on the single-attribute linear regression method | | |
|---|---|---|
| | | POR |
| Ampl | Relevance | 0 |
| | Significance | 0.001 |
| BW | Relevance | 0.105 |
| | Significance | 0.000 |
| CosPhase | Relevance | 0.003 |
| | Significance | 0.101 |
| D1 | Relevance | 0.003 |

TABLE 6-continued

| List of coupling correlations between the logging TOC content and seismic attributes of a shale gas field in western of China based on the single-attribute linear regression method | | |
|---|---|---|
| | | POR |
| | Significance | 0.085 |
| D2 | Relevance | 0.002 |
| | Significance | 0.122 |
| DomFreq | Relevance | 0.021 |
| | Significance | 0.000 |
| Freq | Relevance | 0.057 |
| | Significance | 0.000 |
| Phase | Relevance | 0.008 |
| | Significance | 0.006 |
| RelACImp | Relevance | 0.052 |
| | Significance | 0.000 |
| RmsAmpl | Relevance | 0.161 |
| | Significance | 0.000 |

Figure 9:
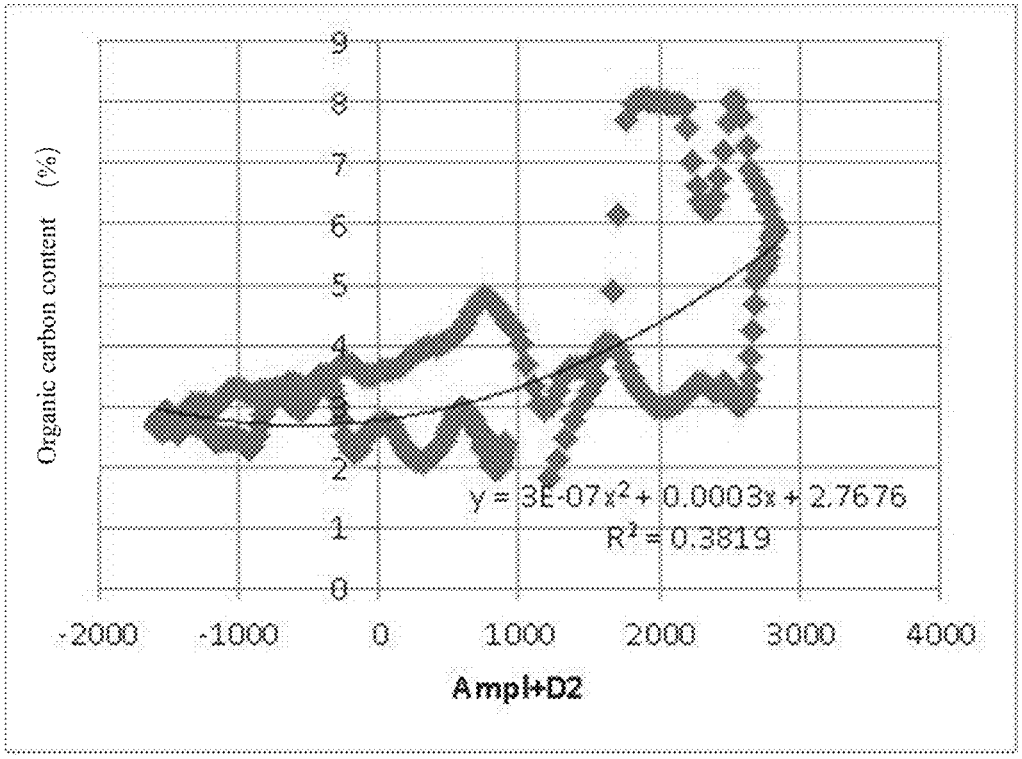
FIG. 9 is a correlation diagram of the coupling of TOC and Ampl+CosPhase+D2 seismic combination attributes of the shale gas field based on a multi-attribute nested combination analysis method in an example.
Figure 10:
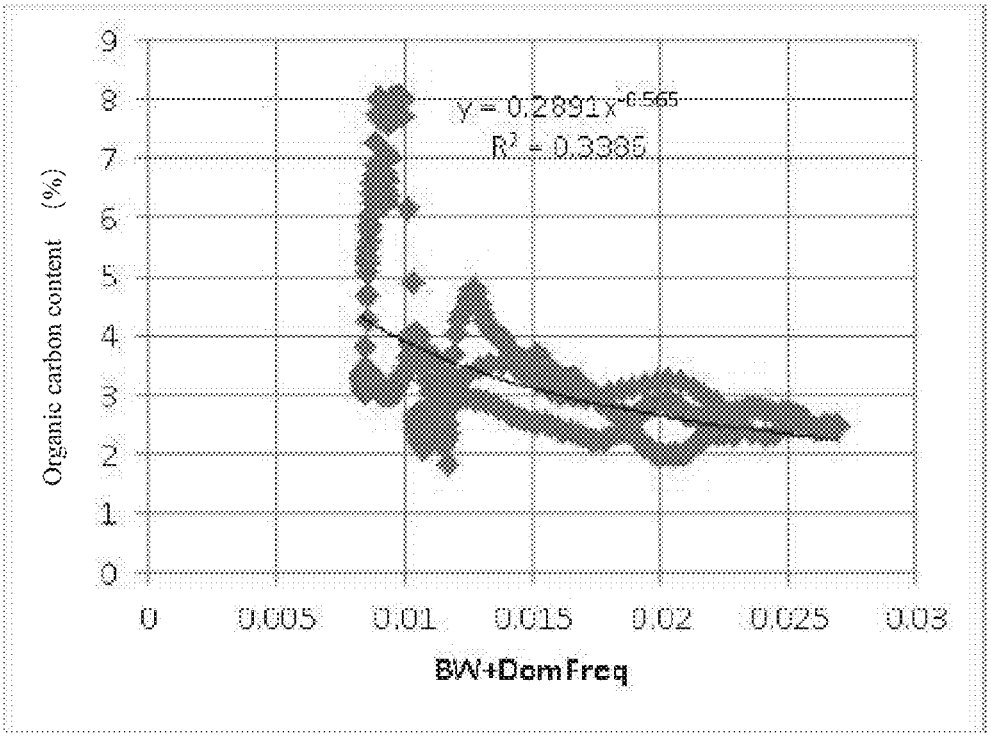
FIG. 10 is a correlation diagram of the coupling of TOC and BW+DomFreq seismic combination attributes of the shale gas field based on the multi-attribute nested combination analysis method in an example.
Figure 11:
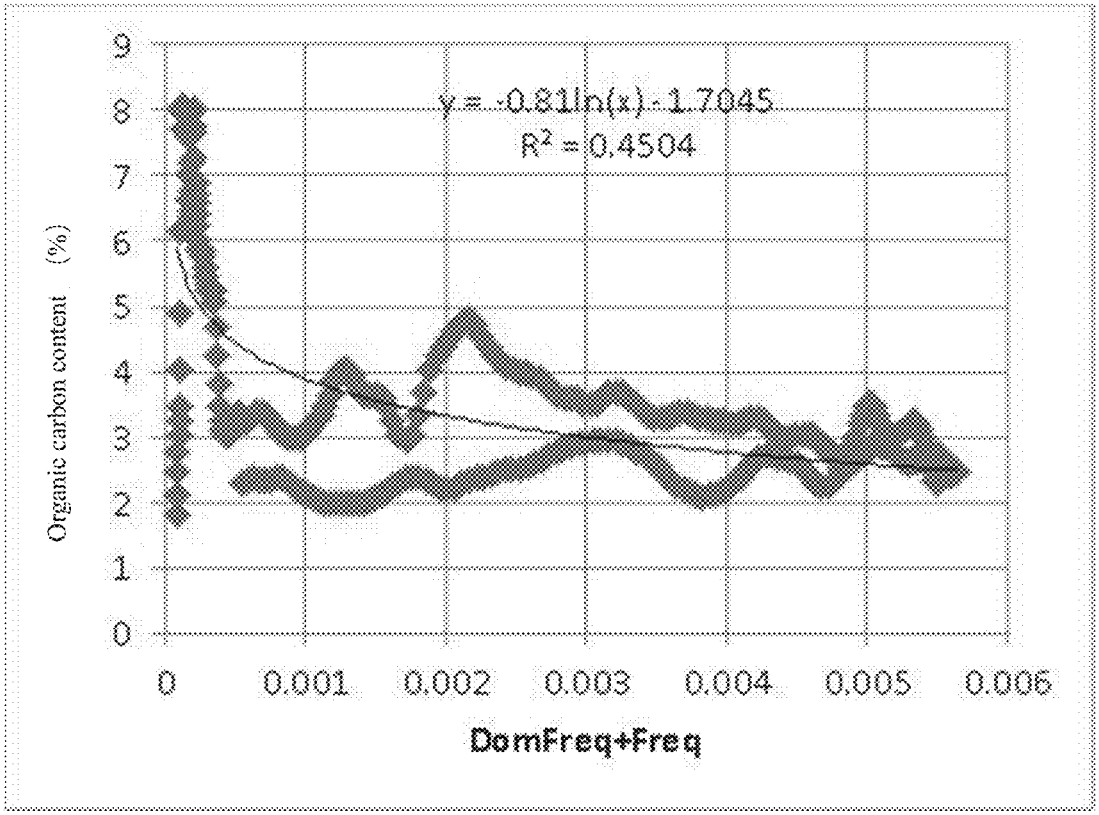
FIG. 11 is a correlation diagram of the coupling of TOC and DomFreq+DomFreq+Freq seismic combination attributes of the shale gas field based on the multi-attribute nested combination analysis method in an example.
Figure 12:
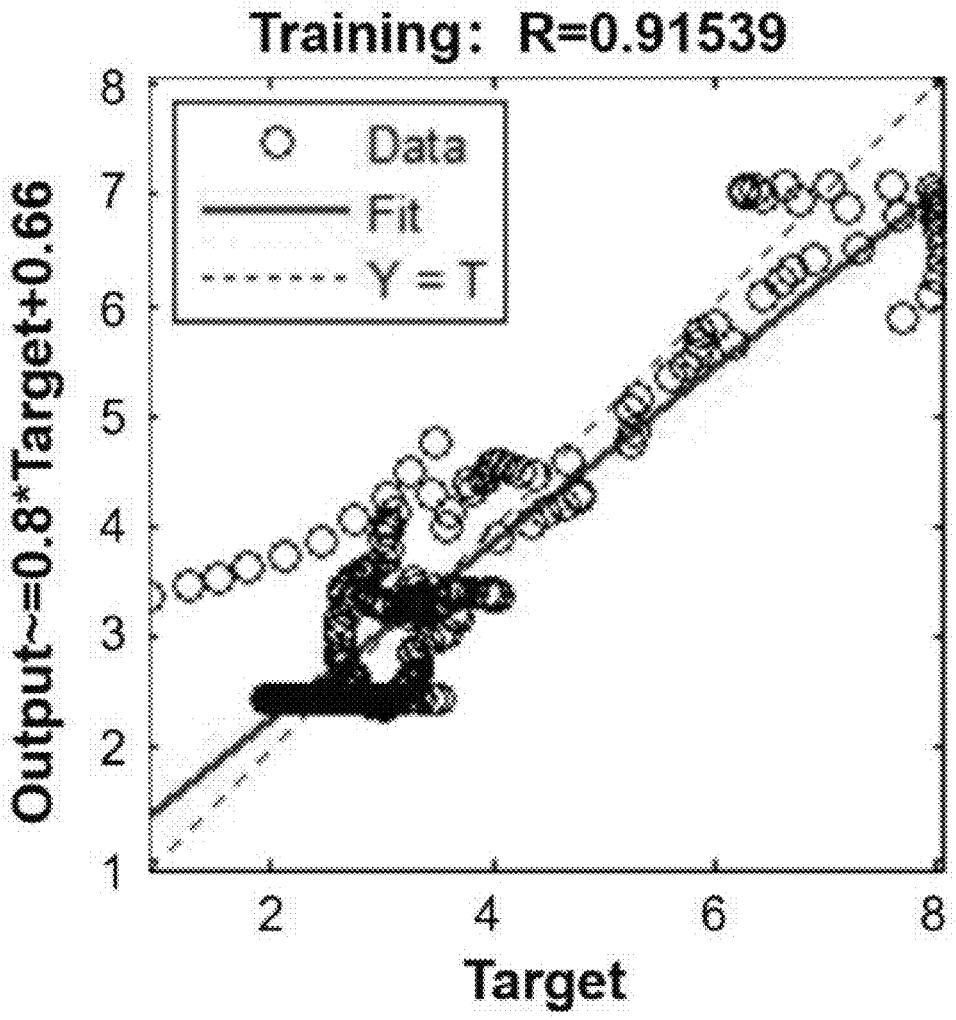
FIG. 12 is a regression analysis diagram of TOC content training data in the coupling of logging TOC and partial seismic combination attributes in the shale gas field based on a self-feedback neural network method in an example.
Figure 13:
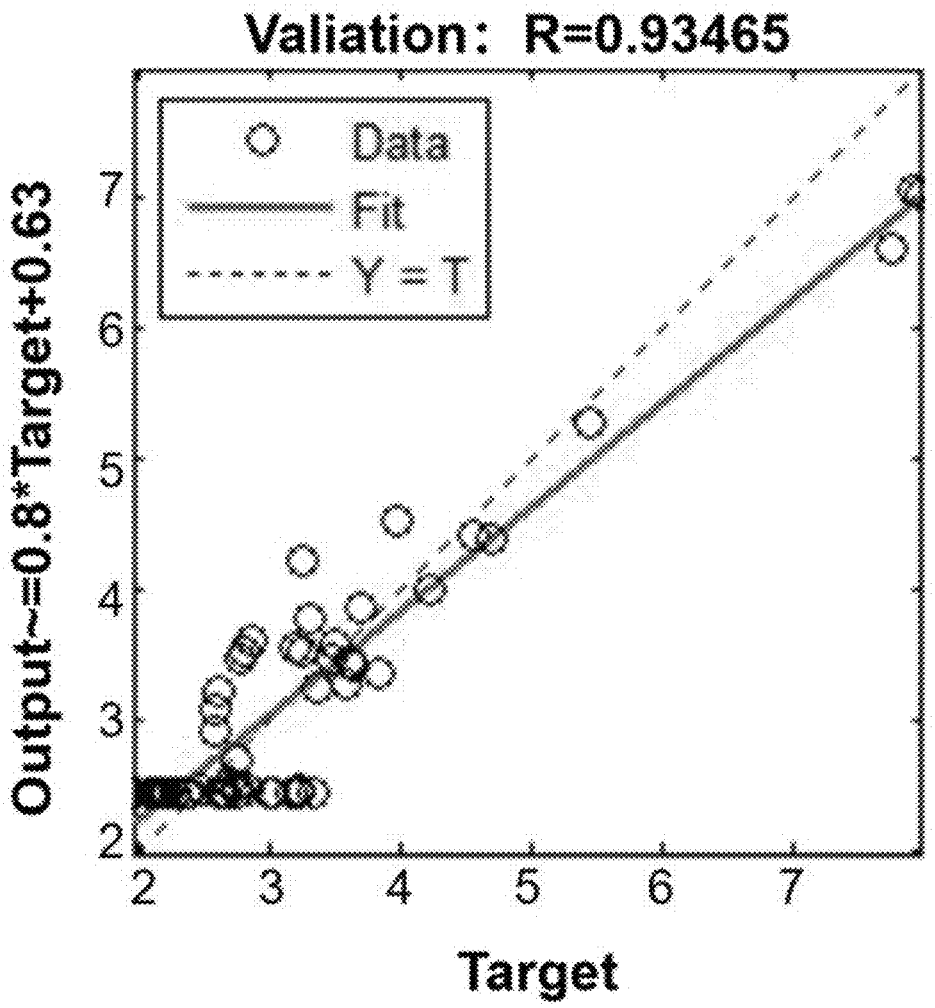
FIG. 13 is a regression analysis diagram of TOC content validation data in the coupling of logging TOC in and partial seismic combination attributes in the shale gas field based on a self-feedback neural network method in an example.
Figure 14:
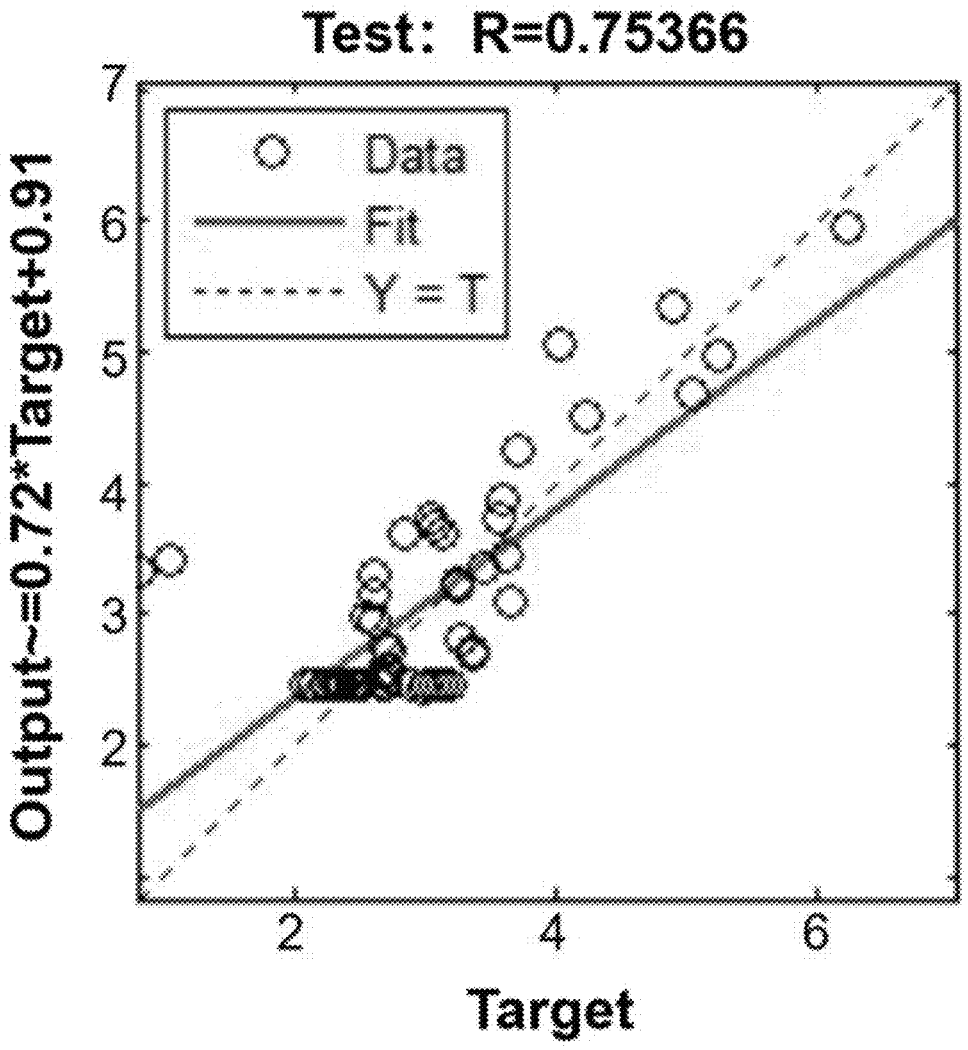
FIG. 14 is a regression analysis diagram of TOC content testing data in the coupling of logging TOC and partial seismic combination attributes in the shale gas field based on a self-feedback neural network method in an example.
Figure 15:
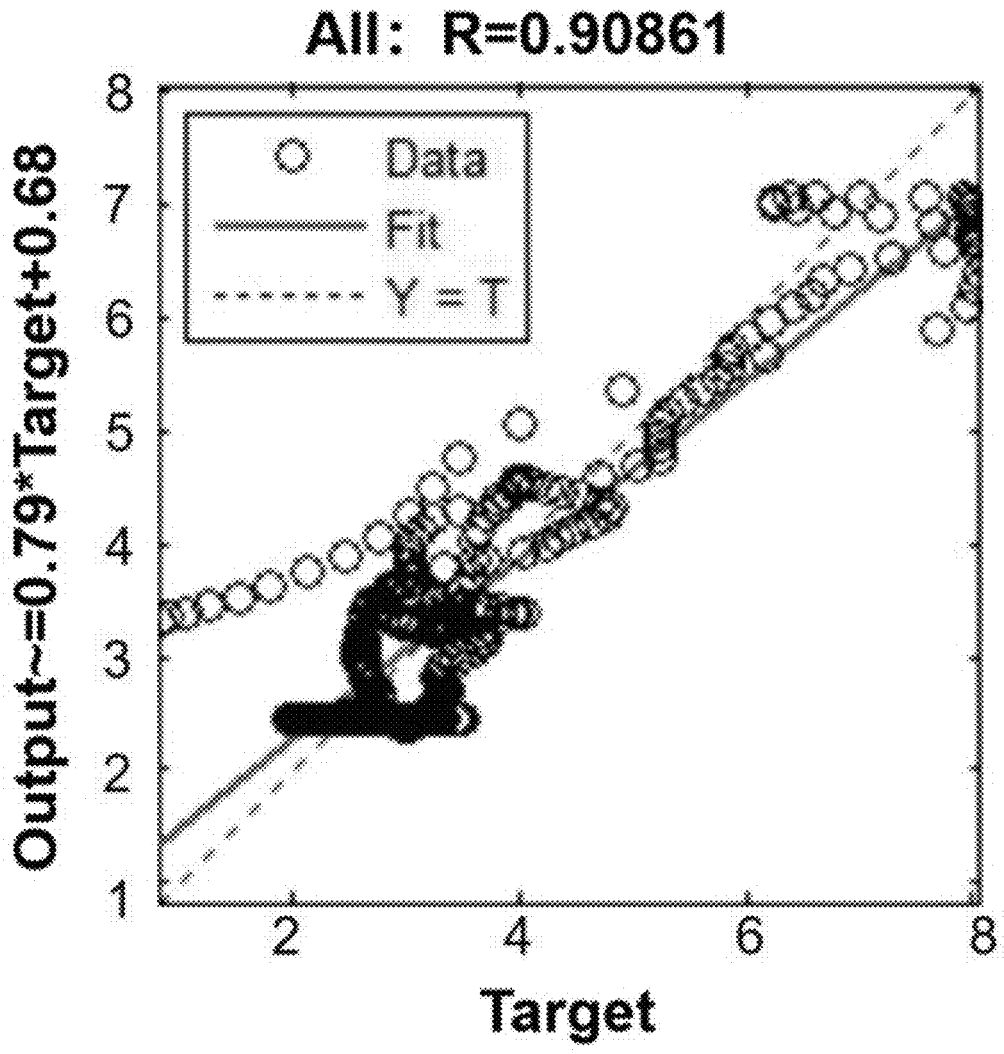
FIG. 15 is a regression analysis diagram of total TOC content data in the coupling of TOC and partial seismic combination attributes in the shale gas field based on a self-feedback neural network method in an example.
Figure 16:
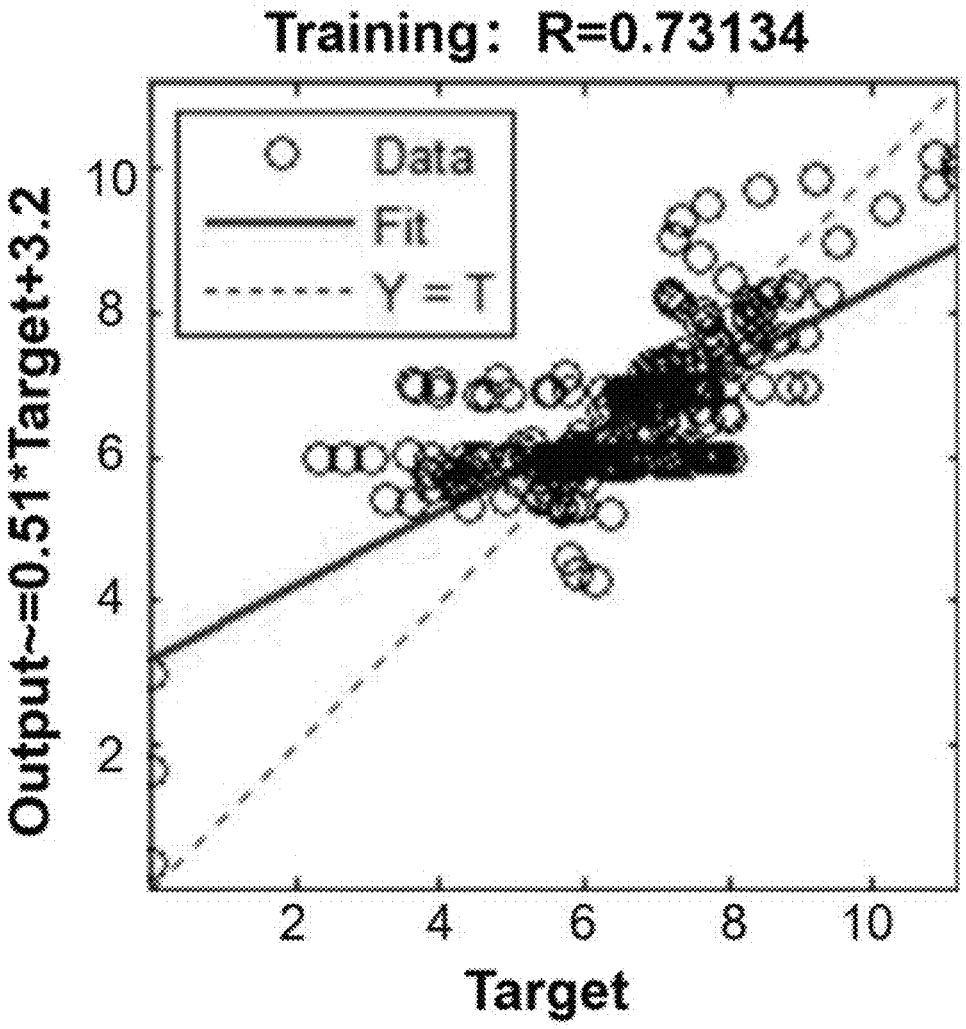
FIG. 16 is a regression analysis diagram of porosity training data in the coupling of porosity and partial seismic combination attributes in the shale gas field based on a self-feedback neural network method in an example.
Figure 17:
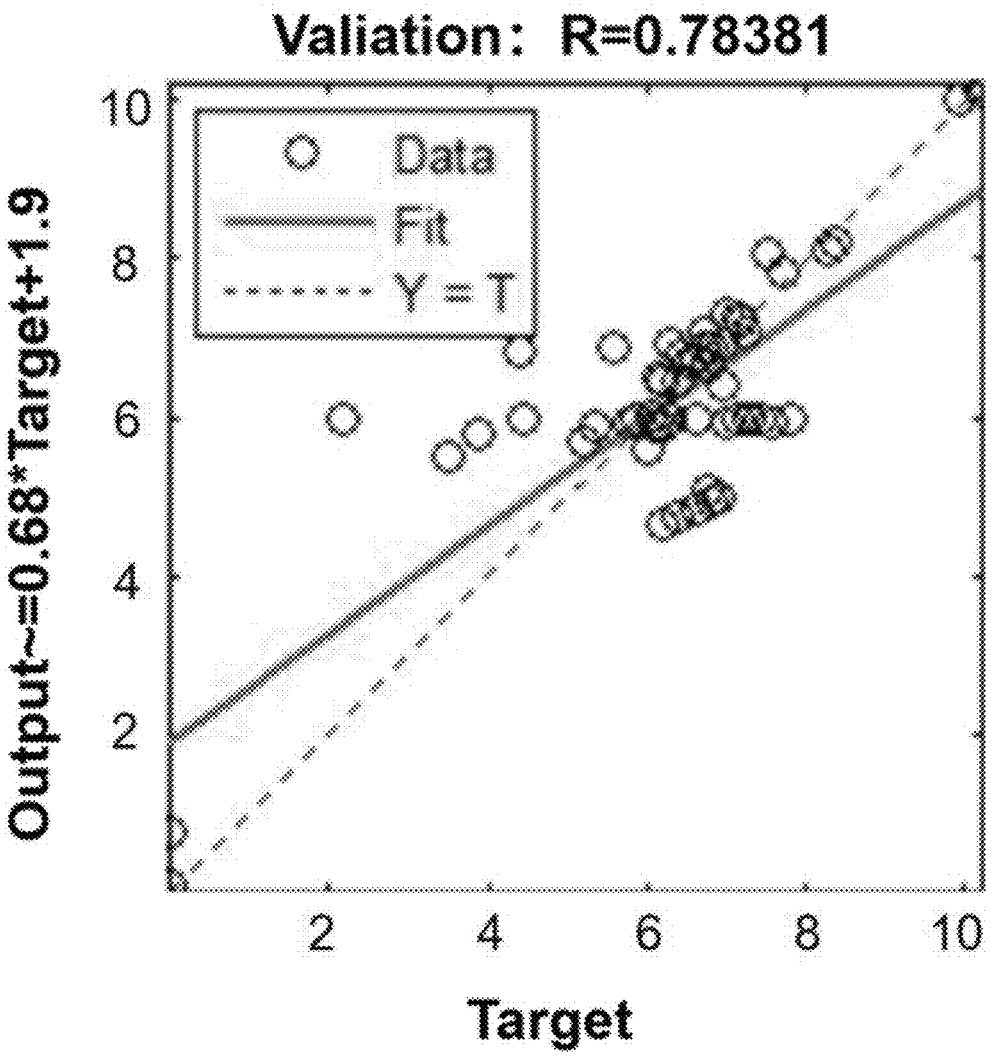
FIG. 17 is a regression analysis diagram of porosity validation data in the coupling of porosity and partial seismic combination attributes in the shale gas field based on a self-feedback neural network method in an example.
Figure 18:
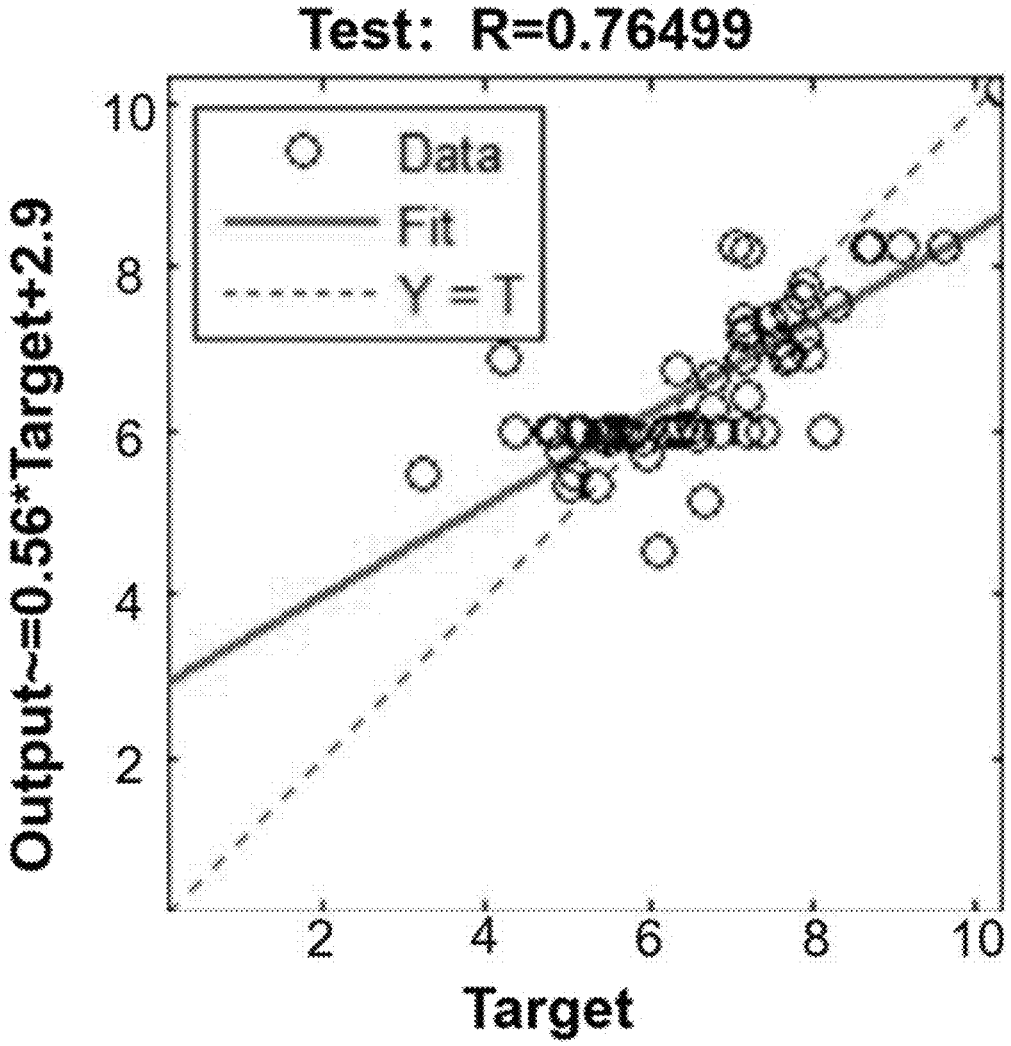
FIG. 18 is a regression analysis diagram of porosity testing data in the coupling of porosity and partial seismic combination attributes in the shale gas field based on a self-feedback neural network method in an example.
Figure 19:
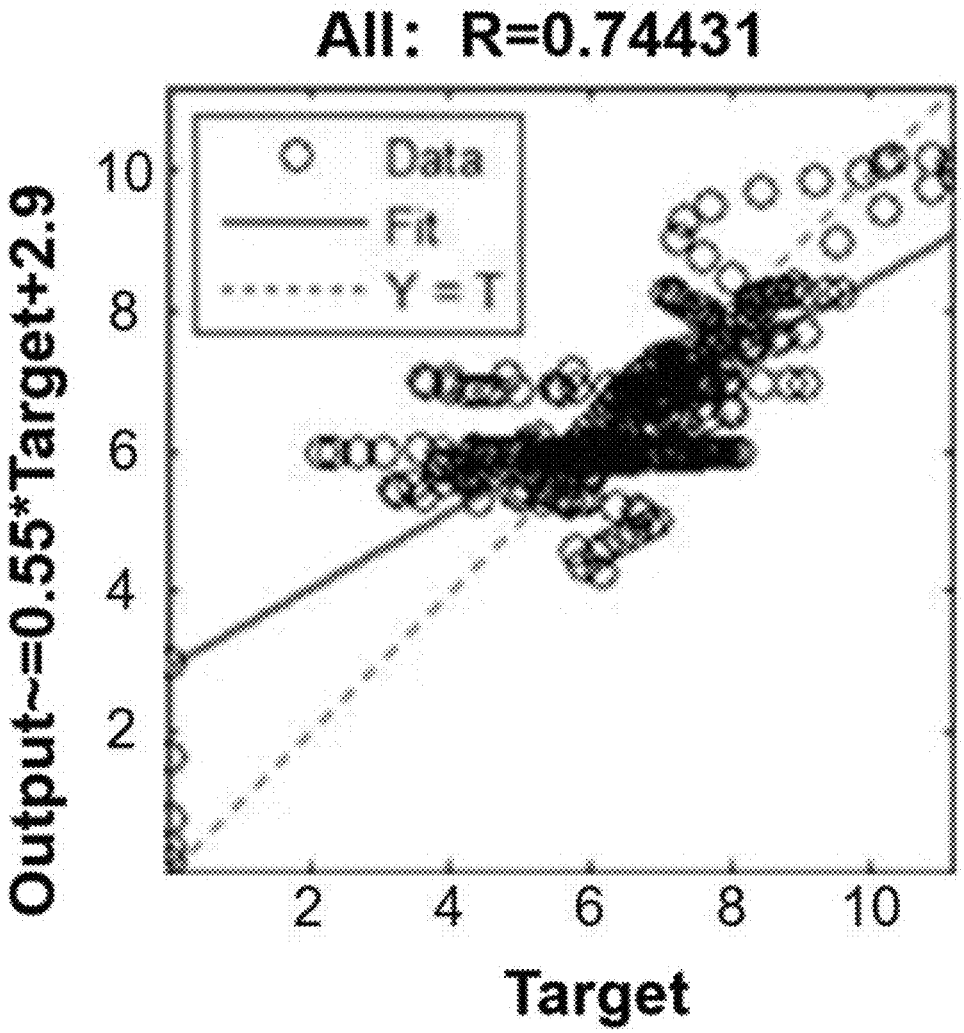
FIG. 19 is a regression analysis diagram of total porosity data in the coupling of porosity and partial seismic combination attributes in the shale gas field based on a self-feedback neural network method in an example.

The results of the TOC content and porosity interpretation model of the shale gas field in western of China, which is established based on the well-seismic coupling multi-attribute nested combination analysis method, are as follows: the correlations of combined seismic body attributes Ampl+CosPhase+D2, BW+DomFreq, DomFreq+Freq and the logging TOC content are significantly improved compared to the original single attributes, but are still not as good as the single attributes RelAclmp and RmsAmpl (see FIG. 9, FIG. 10 and FIG. 11); and the coupling correlation between 7 combined seismic body attributes and the porosity has not achieved a desired effect. It can thus be seen that the linear correlation between the logging TOC content and porosity of a shale gas field in western of China and the seismic body attributes is relatively weak, and the seismic body attributes cannot be used to accurately predict the TOC content and porosity.

The results of a TOC content and porosity interpretation model of the shale gas field in western of China, which is established based on the well-seismic coupling multi-attribute self-feedback neural network method, are as follows: the fitting of the TOC content by the self-feedback neural network method reaches a very high extent; as can be seen from FIG. 12, FIG. 13, FIG. 14 and FIG. 15, a coincidence correlation coefficient R of a training sample is 0.91539, a coincidence degree of a validation sample is 0.93465, a coincidence degree of a test sample is 0.75366, and a coincidence degree of a total sample is 0.90861; the fitting of the porosity by the self-feedback neural network method also reaches an ideal requirement; as can be seen from FIG. 16, FIG. 17, FIG. 18 and FIG. 19, a coincidence correlation coefficient R of the training sample is 0.73134, a coincidence degree of the validation sample is 0.78381, a coincidence degree of the test sample is 0.76499, and a coincidence degree of the total sample is 0.74431.

Figure 20:
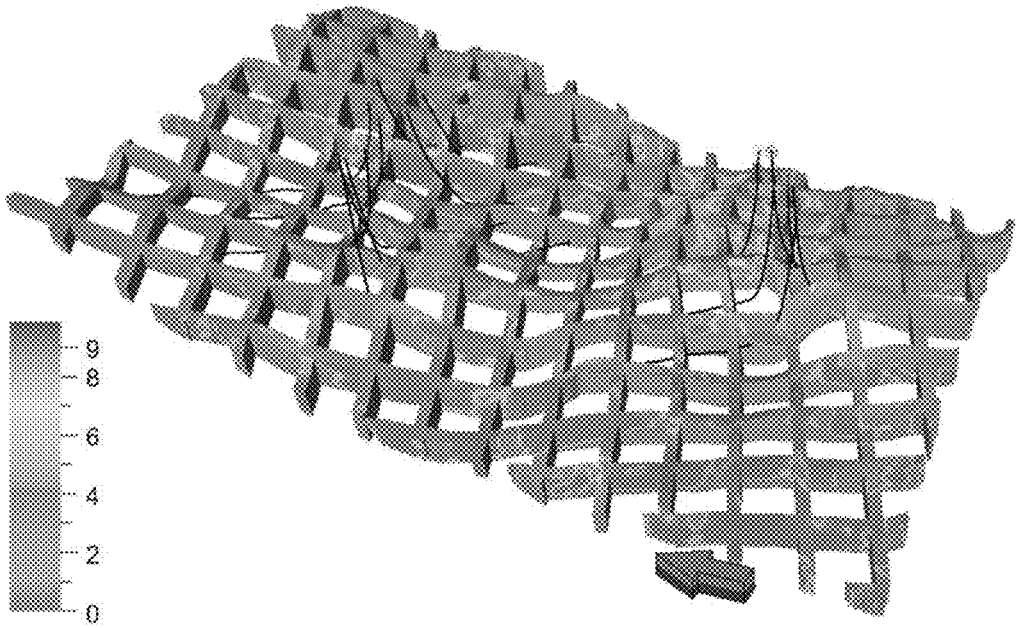
FIG. 20 is a diagram f a 3D seismic TOC content interpretation model of a shale gas field predicted by using 3D seismic body attributes based on a well-seismic seismic coupling self-feedback neural network method in an example.
Figure 21:
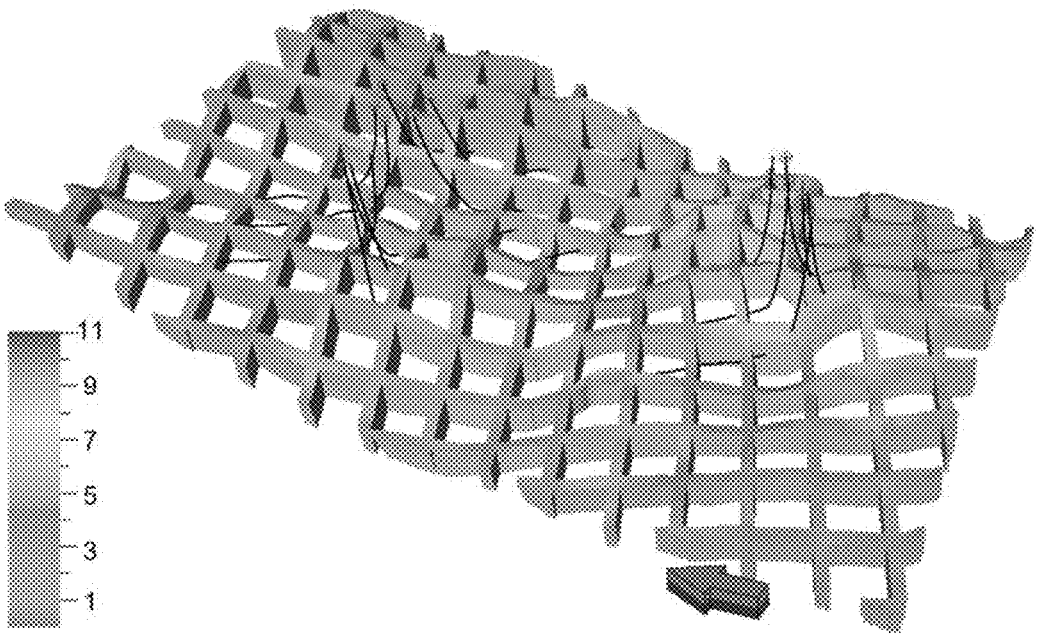
FIG. 21 is a diagram of a 3D seismic porosity interpretation model of a shale gas field predicted by using 3D seismic body attributes based on a well-seismic coupling self-feedback neural network method in an example.

It can thus be seen that as far as the shale gas field in western of China is concerned, the TOC content and porosity predicted by the multi-attribute self-feedback neural network method achieve satisfactory results; FIG. 20 and FIG. 21 are 3D models of the TOC content and porosity in the shale gas field in western of China, which are predicted on the basis of the well-seismic coupling self-feedback neural network method and by using the 3D seismic body attributes. This 3D model reflects the change trend of the TOC content and porosity in the shale gas field in western of China in a 3D space. Obviously, the resolution of this model is relatively low, such that this model cannot effectively characterize the heterogeneity characteristics of TOC content and porosity.

The shale layer actually exists in the underground geological body. Therefore, how to use artificially established 3D meshes to accurately reproduce spatial in-situ positions of top and bottom surfaces of the layer group of the shale formation and interfaces of the small layers in the layer group through lithofacies-well-seismic coupling is a key to determine whether the shale layer model can accurately characterize lithofacies mechanical parameters and the heterogeneity of the in-situ stress field at an in-situ position of an underground reservoir in a 3D space.

(2) An in-situ 3D mesh model of the shale formation is established on the basis of lithofacies-well-seismic coupling.

S3: establishing a spatial in-situ framework of the layer group based on lithofacies-electrical facies of vertical well-seismic coupling.

(a) A lithofacies-electric lithofacies of vertical well coupling layering mode and an electric lithofacies characteristic response mode (collectively referred to as a lithofacies-electrical facies coupling in-situ layering model) for top and bottom surfaces of a layer group and interfaces of respective small layers in the layer group are established based on characteristics of vertical well lithofacies under exploration evaluation, and characteristics of a lithology indicator curve, a porosity indicator curve, or an oil-gas-containing indicator curve, to form an in-situ spatial framework of the top and bottom surfaces of the layer group and interfaces of the small layers in the layer group at the location of a drilling well point.

A Lithofacies-electric facies coupling laying mode for top and bottom surfaces of a main shale gas-producing layer and interfaces of subordinate small layers 1 to 4 in the Wufeng-Longmaxi group in a certain area in western of China is established by using lithofacies characteristics, and characteristics of a lithology indicator curve (GR), a porosity indicator curve (AC, DEN, CNL), and an oil-gas-containing indicator curve (RT, RXO) extracted from core data of a vertical well under exploration evaluation in a target area. A characteristic response pattern (Table 7) of electrical facies in respective small layers of the main shale gas-producing layer of Wufeng-Longmaxi grouoop in a certain area in western of China is obtained by statistics by using characteristics of a lithology indicator curve (GR), a porosity indicator curve (AC, DEN, CNL), and an oil-gas-containing indicator curve (RT, RXO) of respective small layers in the target area. The standards of in-situ identification and comparison of interfaces between subordinate small layers 1 to 4 of the shale gas main-producing layer of Wufeng-Longmaxi group in a certain area in western of China are formed by using the lithofacies-electric facies coupling in-situ layering mode composed these two patterns.

TABLE 7

Electric facies characteristic response modes of four subordinate small layers under the main shale gas-producing layer of Wufeng-Longmaxi group in a certain area of western in China

| Small layer | Feature | GR (API) | AC (μs/ft) | CNL (%) | DEN (g/cm 3) | RT (Ω · m) | RXO (Ω · m) |
|---|---|---|---|---|---|---|---|
| 4 | Minimum-maximum | 161.34-246.85 | 78.24-99.89 | 10.19-19.24 | 2.52-2.73 | 4.13-15.42 | 5.64-15.38 |
| | Average | 204.43 | 90.28 | 16.0 | 2.59 | 10.35 | 10.87 |
| 3 | Minimum-maximum | 166.41-207.83 | 84.64-89.02 | 13.60-16.83 | 2.50-2.58 | 8.00-20.70 | 10.12-19.76 |
| | Average | 180.05 | 86.32 | 14.90 | 2.55 | 16.7 | 17.20 |
| 2 | Minimum-maximum | 205.83-354.85 | 77.50-88.45 | 10.75-19.79 | 2.45-2.57 | 5.04-70.70 | 14.54-63.10 |
| | Average | 257.88 | 84.30 | 13.9 | 2.50 | 29.21 | 30.77 |
| 1 | Minimum-maximum | 114.22-321.73 | 58.18-86.38 | 9.82-19.79 | 2.50-2.65 | 8.81-62.22 | 12.76-90.99 |
| | Average | 183.44 | 77.81 | 17.56 | 2.59 | 28.92 | 35.32 |

(b) In-situ depth information of the top and bottom surfaces of the layer group identified by the vertical well under exploration evaluation is projected onto a seismic-time profile by using by a time-depth conversion relationship established by a synthetic recording method, to form a well-seismic coupling relationship of top and bottom interfaces of a main oil-producing layer group of the shale formation. Tracking and time data extraction of the top and bottom interfaces of a main oil-producing layer of the shale formation are completed on a seismic section based on this coupling relationship. The time data of the top and bottom interfaces of the layer group is converted into depth data by using the established time-depth conversion relationship, and a structural distribution model of the top and bottom surfaces of the layer group is established under the condition of ensuring that a residual at the vertical well under exploration evaluation is zero by means of a multiple mesh approximation algorithm and by using the depth data as a main input, and elevation data of the vertical well under exploration evaluation as a hard constraint condition, to form a spatial in-situ framework of the layer group of the shale formation.

Figure 22:
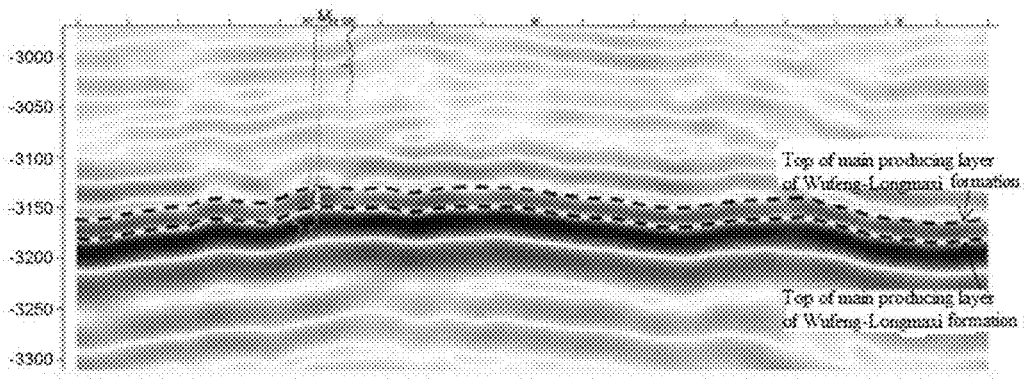
FIG. 22 is a diagram of a seismic-vertical well coupling recognition model of top and bottom interfaces of a main shale gas-producing layer in a certain area of western in China in an example.
Figure 23:
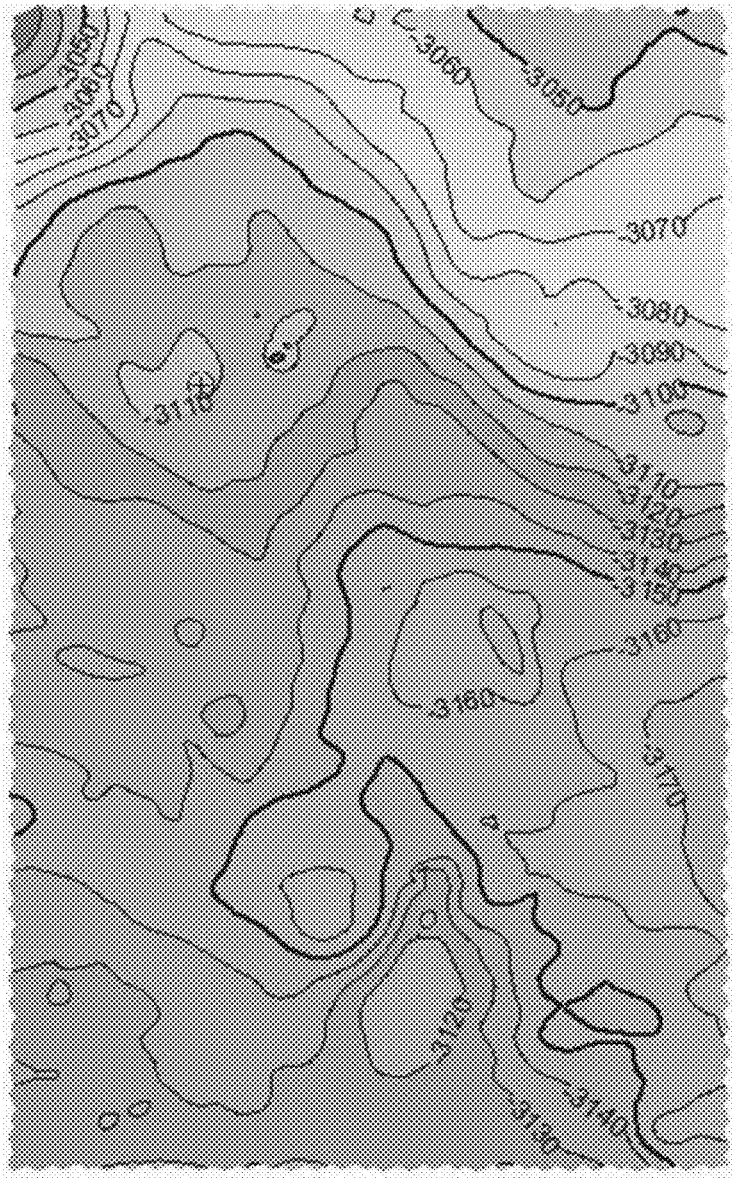
FIG. 23 is a diagram of a structural distribution model of a top surface of a main shale gas-producing layer in a certain seismic working area of western in China in an example.
Figure 24:
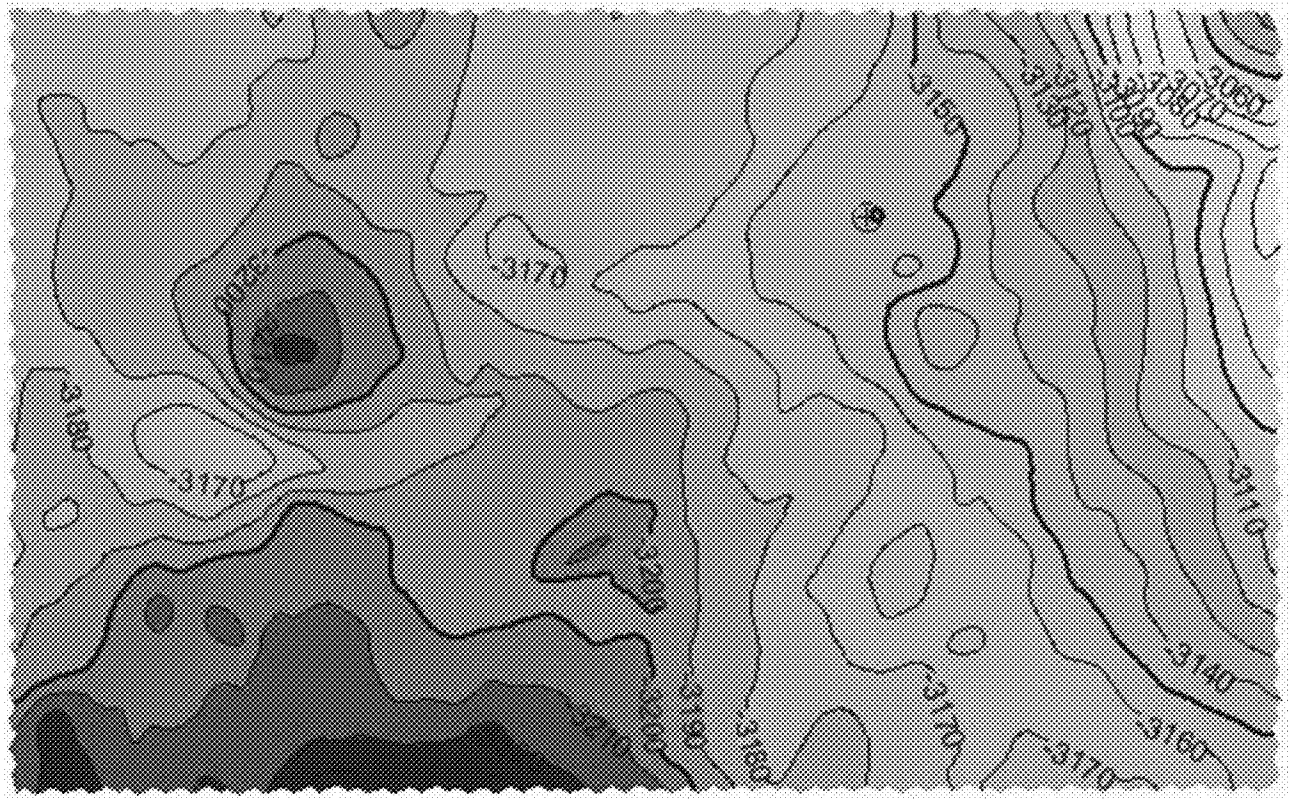
FIG. 24 is a diagram if a structural distribution model of a bottom surface of a main shale gas-producing layer in a certain seismic working area of western in China in an example.

FIG. 22 is a diagram of a seismic-vertical well coupling recognition model for seismic-horizontal well coupling of top and bottom interfaces of a main shale gas-producing layer of Wufeng-Longmaxi group in a certain area of western in China. In FIG. 22, in-situ depth information of the top and bottom surfaces of Wufeng-Longmaxi group identified by a well M is projected onto a seismic-time profile based on a time-depth conversion relationship established by synthetic recording of the M well, to form a well-seismic coupling relationship of top and bottom interfaces of the main oil-producing layer group of the Wufeng-Longmaxi group in a certain area of western in China. The tracing of the top and bottom interfaces of the Wufeng-Longmaxi group (the black dashed line marked in FIG. 22) and the extraction of time data have been completed on the seismic profile based on this coupling relationship. According to the above method, the tracking of the top and bottom interfaces of the Wufeng-Longmaxi group in a 3D seismic working area (the black dotted line marked in FIG. 22) and the time data extraction are completed. Then, the time data of the top and bottom interfaces of the Wufeng-Longmaxi group is converted into depth data by using the established time-depth conversion relationship. The establishment of a structural distribution model of the top and bottom surfaces of the Wufeng-Malongxi group is completed (see FIG. 23 and FIG. 24) under the condition of ensuring that a residual at the vertical well under exploration evaluation is zero by means of a multiple mesh approximation algorithm and by using the depth data as a main input, and evaluation data of the top and bottom surfaces of Wufeng-Malongxi group of the vertical well under exploration evaluation as a hard constraint condition, thereby forming a spatial in-situ framework of the top and bottom interfaces of a main shale gas-producing layer of the Wufeng-Longmaxi group in a certain area of western in China.

S4: forming a spatial distribution trend framework of small layers of the shale formation by using 3D visualization comparison of the vertical well.

The 3D visualized comparison of small layers of the vertical well is developed by using a lithofacies-electrical facies coupling in-situ layering mode of interfaces of respective small layers in the previously established layer group, elevation data of the top and bottom surfaces of the small layers at respectively vertical well positions is extracted, and a small layer framework in the layer group is established. A structural distribution model of the top and bottom surfaces of small layers is established according to a position proximity principle by selecting a structural distribution model of top and bottom surfaces of the layer group close to the top and bottom surfaces of the small layer as a main input, and the elevation data of the top and bottom surfaces of each small layer as a hard constraint by means of a multiple mesh approximation principle under the condition of ensuring that the residual at the vertical well point is zero, thereby forming a spatial distribution trend framework of the small layers of the shale formation.

Figure 25:
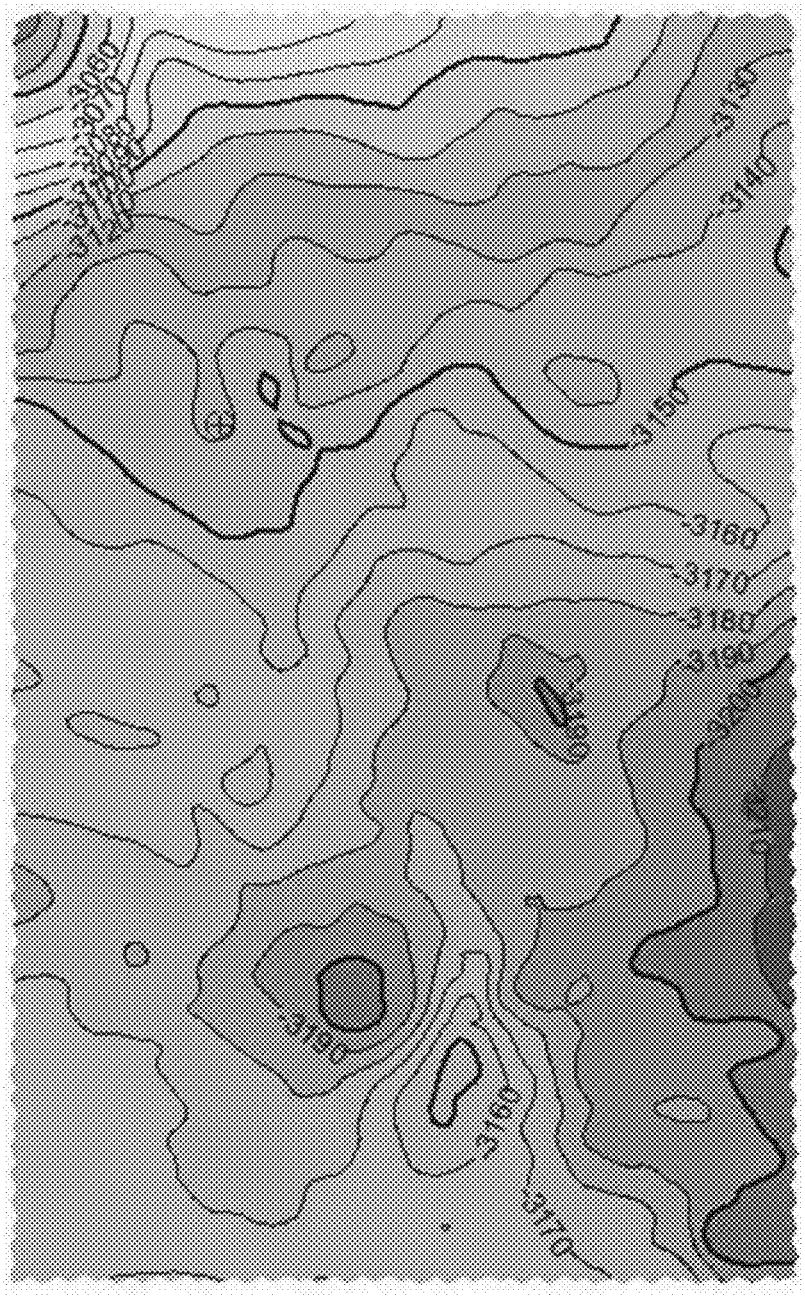
FIG. 25 is a diagram of a structural distribution model of a top surface of a small layer 2 of the main shale gas-producing layer in a certain area of western in China in an example.
Figure 26:
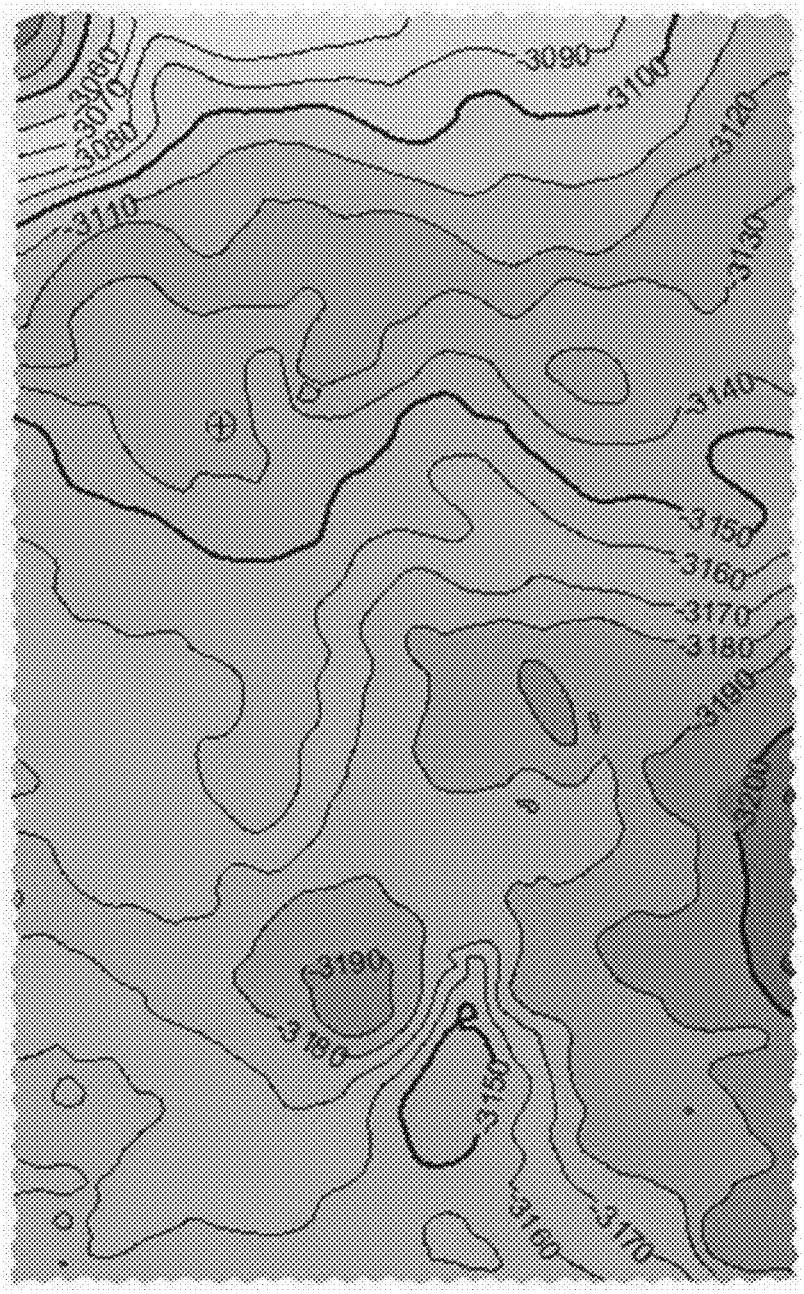
FIG. 26 is a diagram if a structural distribution model of a top surface of a small layer 3 in the main shale gas-producing layer in a certain area of western in China in an example.

FIG. 6 is a sectional view of the small layers of the main shale gas-producing layer of Wufeng-Longmaxi group in western of China. This figure shows vertical well layering results of the small layers 1 to 4 of the main shale gas-producing layer of Wufeng-Longmaxi group in a certain area in western of China, which are obtained by using the previously established lithofacies-electrical facies coupling in-situ layering mode of each small layer in the layer group. FIG. 25 and FIG. 26 respectively show the structural distribution models of the top and bottom surfaces of the small layers 2 and 3 in the main shale gas-producing layer of Wufeng-Longmaxi group in a certain area in western of China. The two structural modes are established respectively by using structural distribution models of top (FIG. 23) and bottom (FIG. 24) surfaces of Wufeng-Longmaxi group as a main input, and the elevation data of the top and bottom surfaces of the small layers 2 and 3 as a hard constraint by means of a multiple mesh approximation principle under the condition of ensuring that the residual at the vertical well point is zero. Finally, a spatial distribution trend framework of the top and bottom surfaces of the subordinate small layers 1 to 4 of the shale gas-producing layer of Wufeng-Longmaxi group in a certain area in western of China is obtained by seismic-vertical well coupling.

Figure 27:
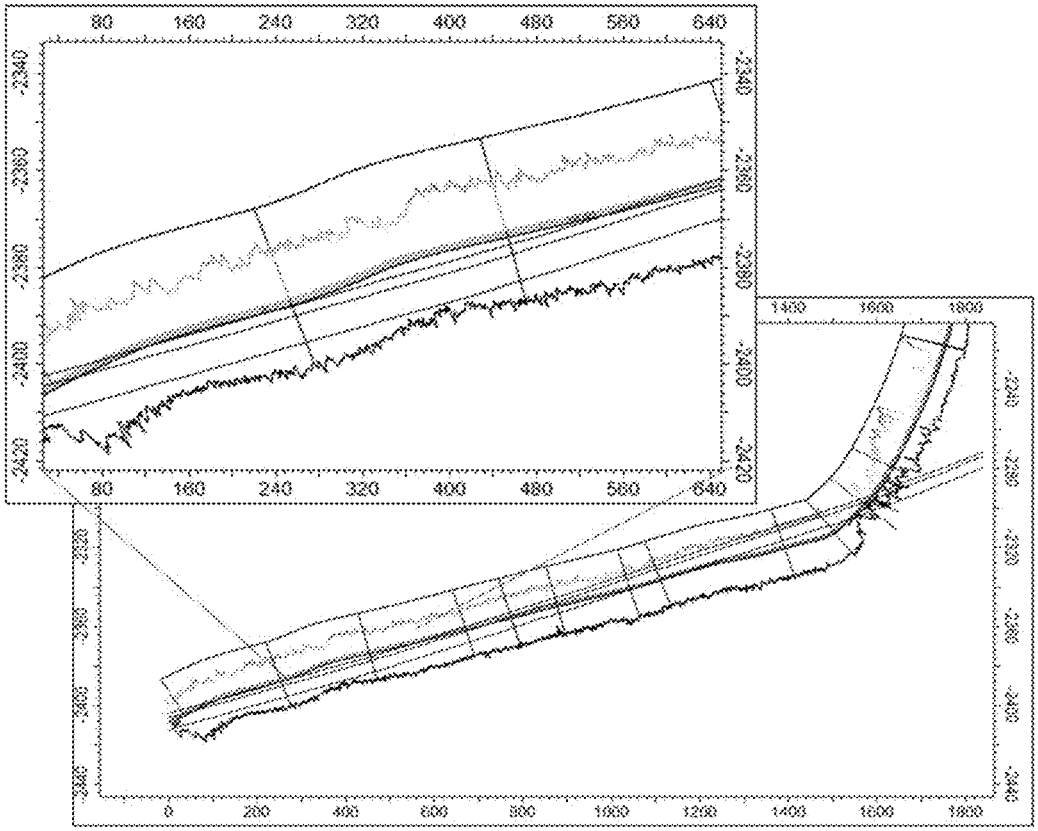
FIG. 27 is a schematic diagram in which a trajectory of a well M1 and top and bottom surfaces of the small layer 2 are not matched in the main shale gas-producing layer in a certain area of western in China in an example.
Figure 28:
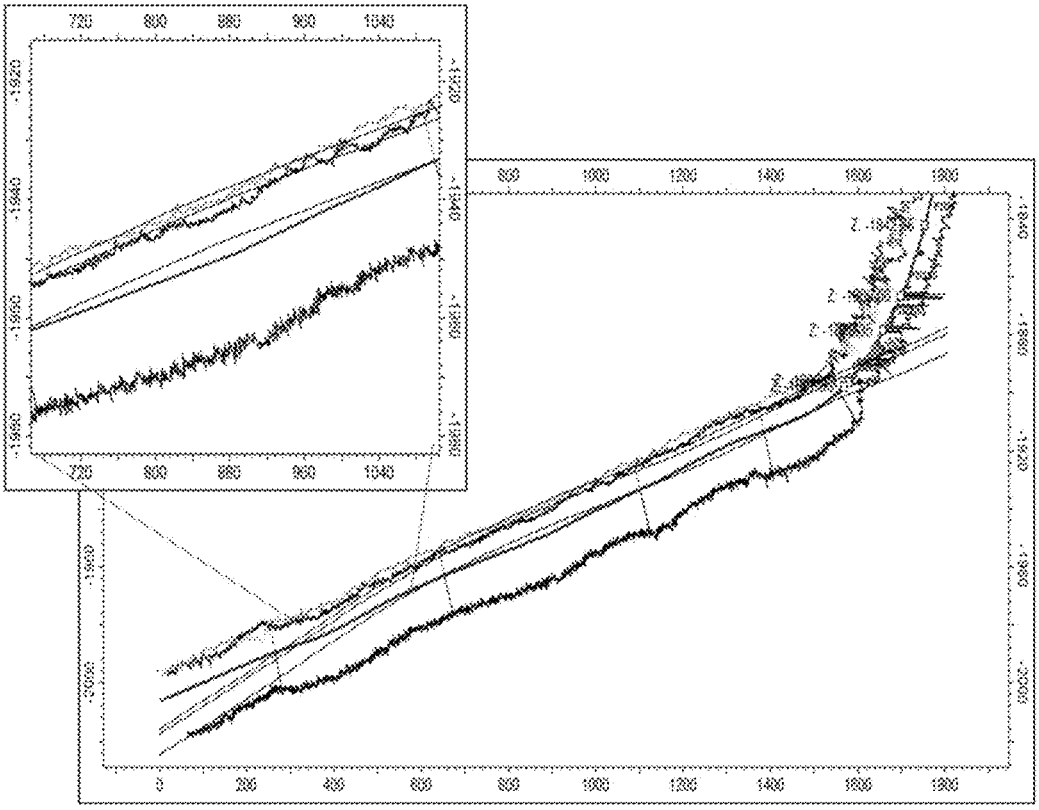
FIG. 28 is a schematic diagram in which a trajectory of a well M2 and top and bottom surfaces of a target small layer 2 are not matched in the main shale gas-producing layer in a certain area of western in China in an example.

Table 8, FIG. 27 and FIG. 28 show a matching degree between the top and bottom surface structures of the main shale gas-producing layer of Wufeng-Longmaxi group in a certain area in western of China and an actual drilling trajectory of a horizontal well. From the actual results, it is impossible to realize the in-situ characterization of the spatial position of each small layer along the trajectory of the horizontal well based on seismic-vertical well coupling.

TABLE 8

A statistical table of the matching degree between the top and bottom surface structures of the top and bottom surfaces of the main shale gas-producing small layer of Wufeng-Longmaxi group in a certain area in western of China and the actual drilling trajectory of the horizontal section of the horizontal well

| Small layer No. | Number of well layers/ number of wells | Length across small layers/m minimum to maximum/average | Matching ratio/% minimum to maximum/average |
|---|---|---|---|
| 1 | 7/7 | 21.78-672.92/139 | 4154-100/91.6 |
| 2 | 69/48 | 25.92-2558/1260.18 | 0-100/49.24 |
| 3 | 3/3 | 1222.79-1515.7/1408.12 | 350-100/67.67 |

S5: establishing an in-situ 3D mesh model of small layers of the shale formation by using 3D visualization comparison of the horizontal well.

A relationship between the horizontal well trajectory and the top and bottom interfaces of a target small layer is determined by using the previously established lithofacies-electrical facies coupling in-situ layering mode of the interfaces of small layers in the layer group and using 3D visualization comparison of the horizontal well. The target small layer along the horizontal well trajectory and the top and bottom interface positions of each small layer adjacent to the target small layer are quantitatively described. Position elevations are extracted to form elevation data of the top and bottom surfaces of the small layers of the horizontal well, and the elevation data is merged with the elevation data of the top and bottom surfaces of the small layer at the vertical well position into a new data set. Meanwhile, a new structural distribution model of the top and bottom surfaces of the small layers based on vertical well+horizontal well is established by using the previously established structural distribution model of the top and bottom surfaces of the small layers as a trend constraint, to finally form an in-situ 3D mesh model of the small layers of shale.

By using a horizontal well 3D visualization small-layer comparison technology involved in "Structural Modeling Method Based on Horizontal Well 3D Visualization Stratigraphic Correlation", the relationship between the horizontal well trajectory and the top and bottom interfaces of the target small layer 2 can be determined by using the established lithofacies-electrical facies coupling in-situ stratification model of the interfaces of the respective small groups in the layer group. Elevation data of the upper and lower interfaces of a horizontal section translayer point is extracted. Meanwhile, top and bottom interface lines of the target small layer along the horizontal well trajectory are drawn on a vertical section by using the previously established lithofacies-electrical facies coupling in-situ layering mode of the interfaces of the respective small layers in the layer group, and the target small layer along the horizontal well trajectory and the top and bottom interface positions of each adjacent layer adjacent to respective small layers are quantitatively described. Finally, the elevation data of top and bottom interface lines of the target small layer, elevation data of the upper and lower interfaces of the horizontal section translayer point, and the elevation data of the top and bottom surfaces of the small layers at the vertical well position are combined to form a new elevation data set for the respective small layers.

Figure 29:
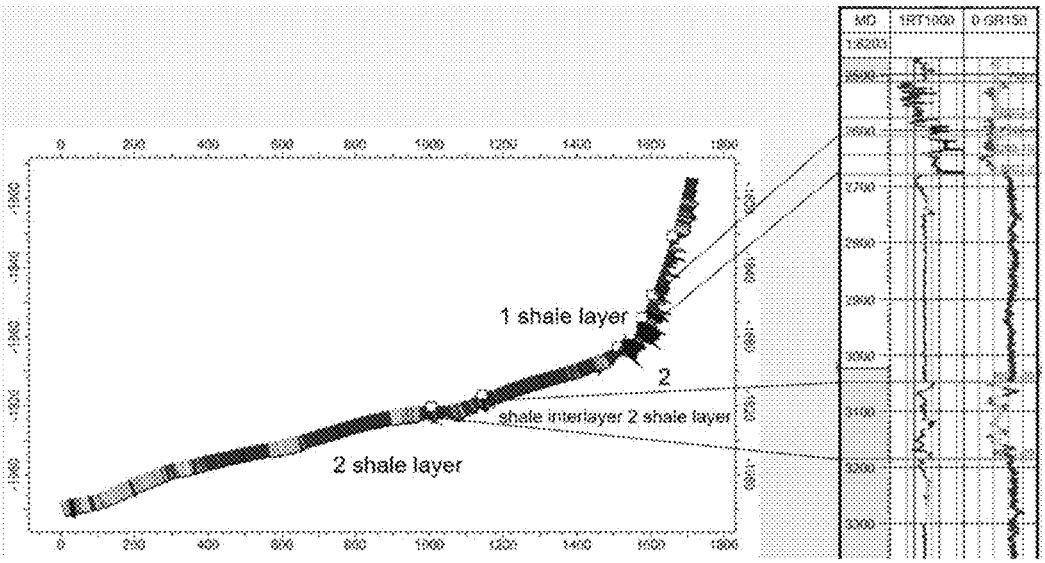
FIG. 29 is a diagram showing a relationship between the trajectory of a horizontal well and top and bottom surfaces of the target small layer 2 in the main shale gas-producing layer in a certain area of western in China in an example.

FIG. 29 shows a horizontal well 3D visualization small-layer comparison technology involved in "Structural Modeling Method Based on Horizontal Well 3D Visualization Stratigraphic Correlation", as well as the determined relationship between the trajectory of a horizontal well in the Luer section of a main shale oil-producing layer of an oil shale formation of certain shale in western of China and the top and bottom surfaces of the target small layer 2.

Figure 30:
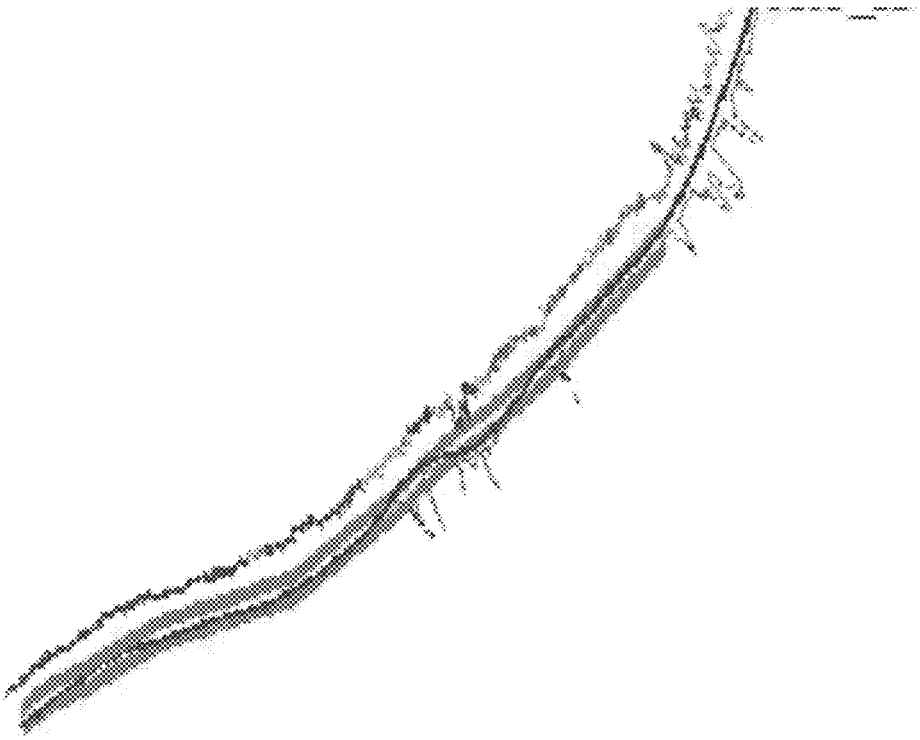
FIG. 30 is a schematic diagram of a trajectory of a horizontal well M3 and top and bottom boundary lines of the target small layer 2 in the main shale gas-producing layer in a certain area of western in China as quantitatively determined in an example.
Figure 31:
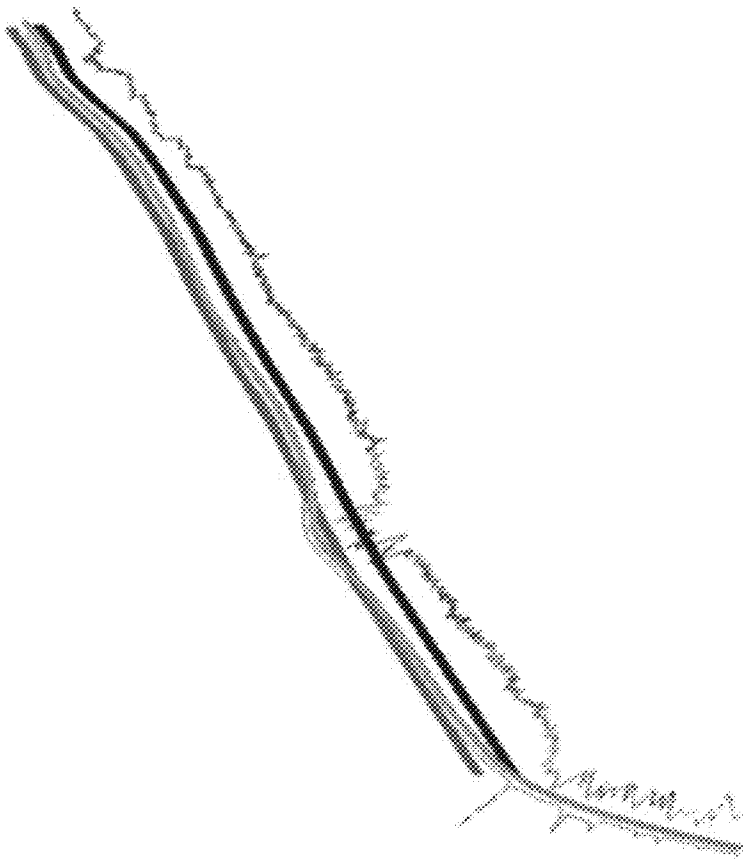
FIG. 31 is a schematic diagram of a trajectory of a horizontal well M4 and top and bottom boundary lines of the target small layer 2 in the main shale gas-producing layer in a certain area of western in China as quantitatively determined in an example.
Figure 32:
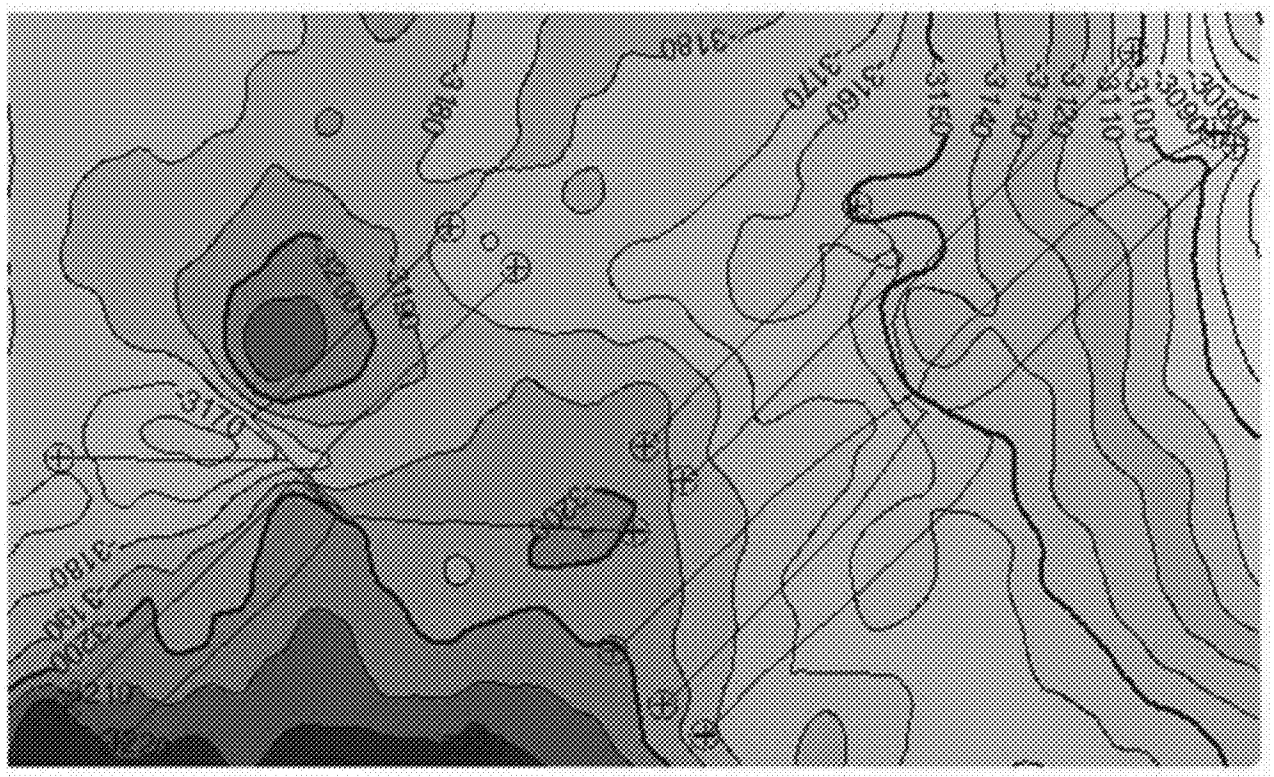
FIG. 32 is a diagram of a structural distribution model of top and bottom surfaces of a small layer 1 in the main shale gas-producing layer in a certain area of western in China in an example.
Figure 33:
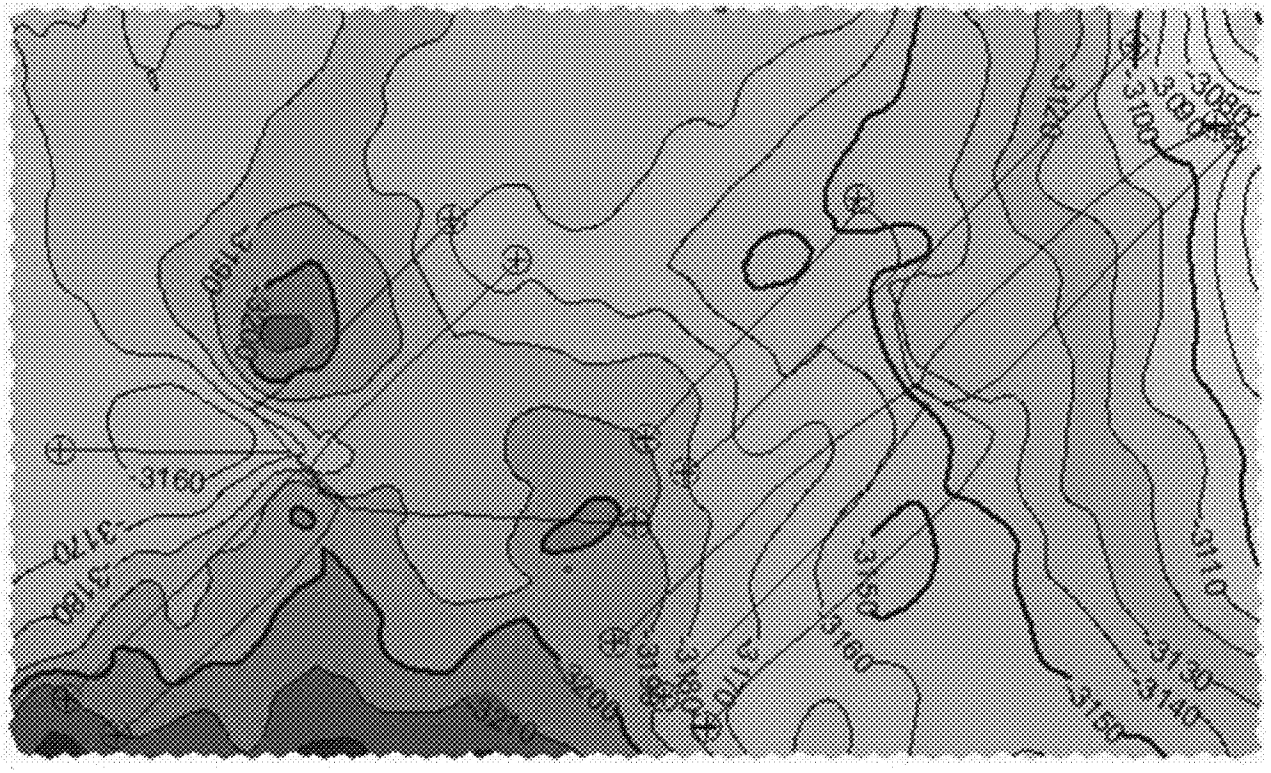
FIG. 33 is a diagram of a structural distribution model of top and bottom surfaces of the small layer 2 in the main shale gas-producing layer in a certain area of western in China in an example.
Figure 34:
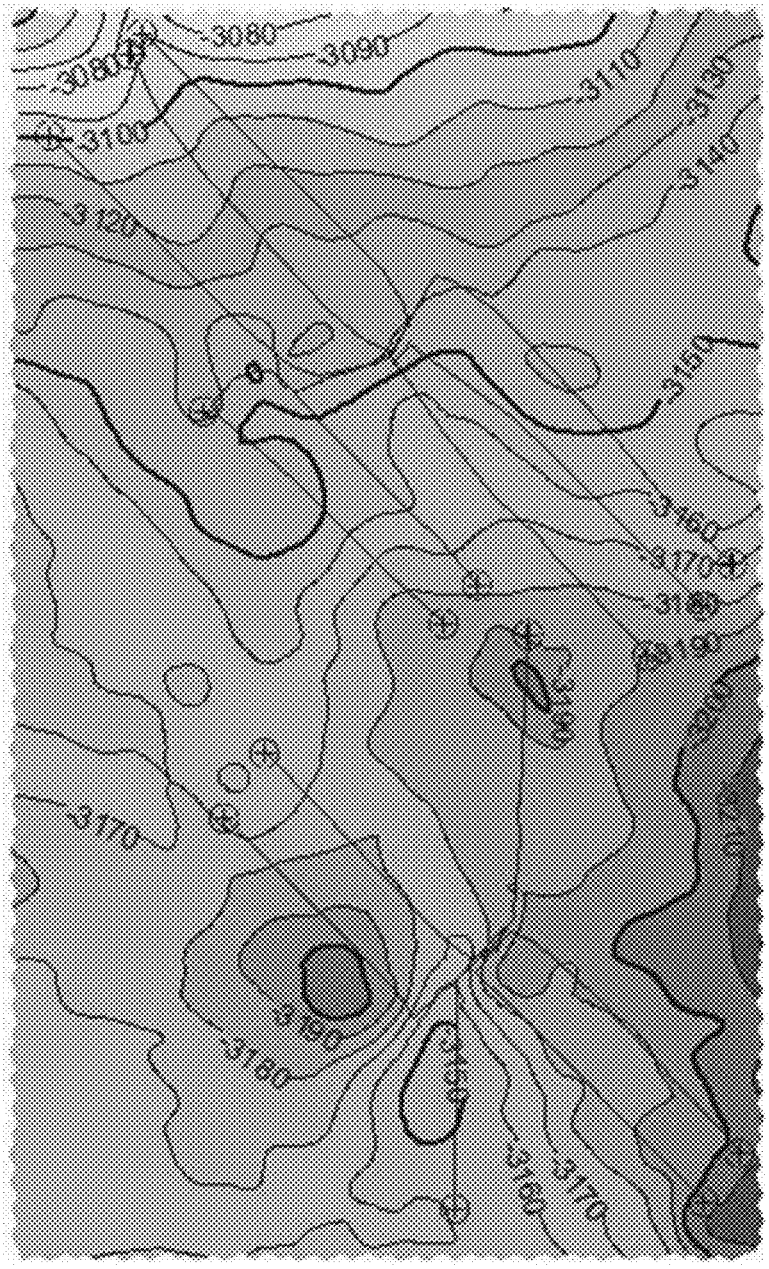
FIG. 34 is a diagram of a structural distribution model of top and bottom surfaces of a small layer 3 in a main shale gas-producing layer in a certain area of western in China in an example.
Figure 35:
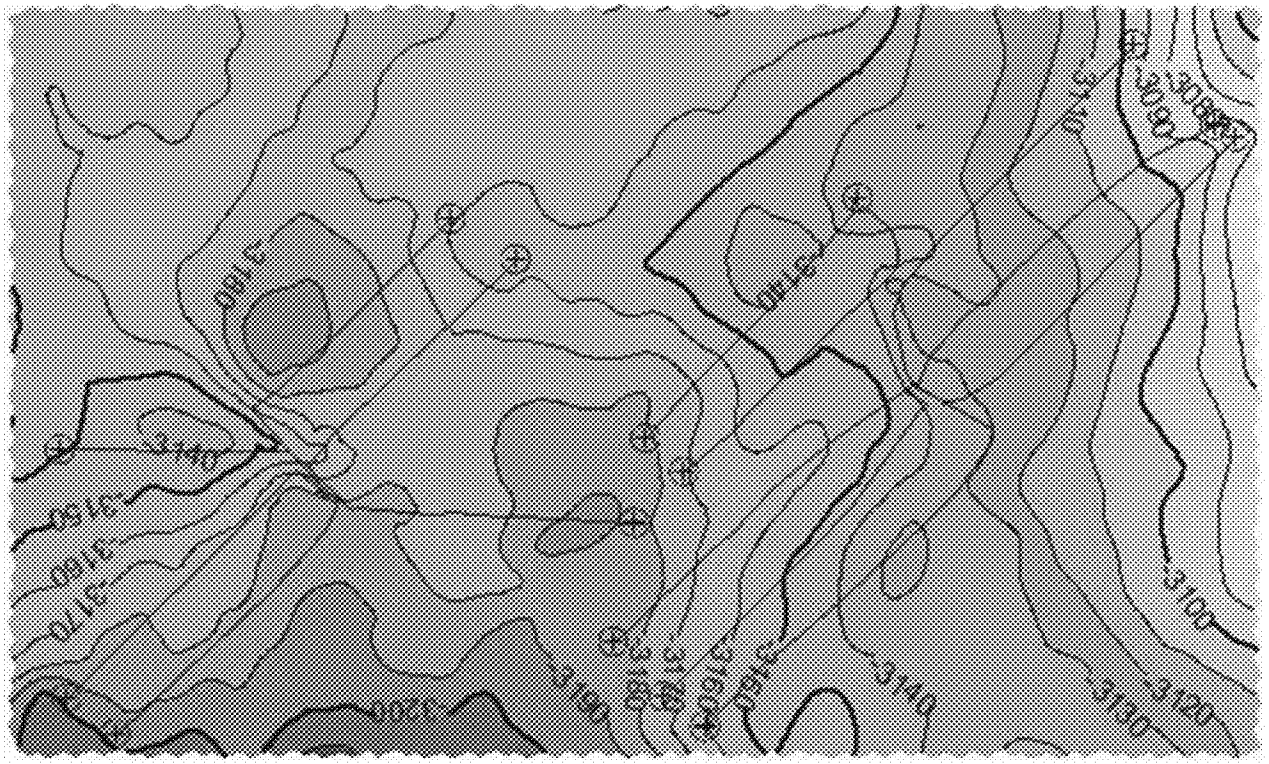
FIG. 35 is a diagram of a structural distribution model of top and bottom surfaces of a small layer 4 in the main shale gas-producing layer in a certain area of western in China in an example.

FIG. 30 and FIG. 31 are top and bottom interface lines of a target small layer of along a horizontal well trajectory, which are drawn on a vertical section along the horizontal well trajectory based on an electric facies characteristic response mode (Table 7) of the target small layer 2 of a main shale gas-producing layer in the Wufeng-Longmaxi group in a certain area of western in China.

Through the above steps, the target small layer along the horizontal well trajectory and the top and bottom interface positions of the adjacent small layers are quantitatively described. Finally, elevation data of top and bottom interface lines of the target small layer, elevation data of the upper and lower interfaces of the horizontal section translayer point, and the elevation data of the top and bottom surfaces of the small layer at the vertical well position are combined to form a new elevation data set for the respective subordinate small layers of the main shale gas-producing layer in the Wufeng-Longmaxi group in a certain area of western in China.

Figure 36:
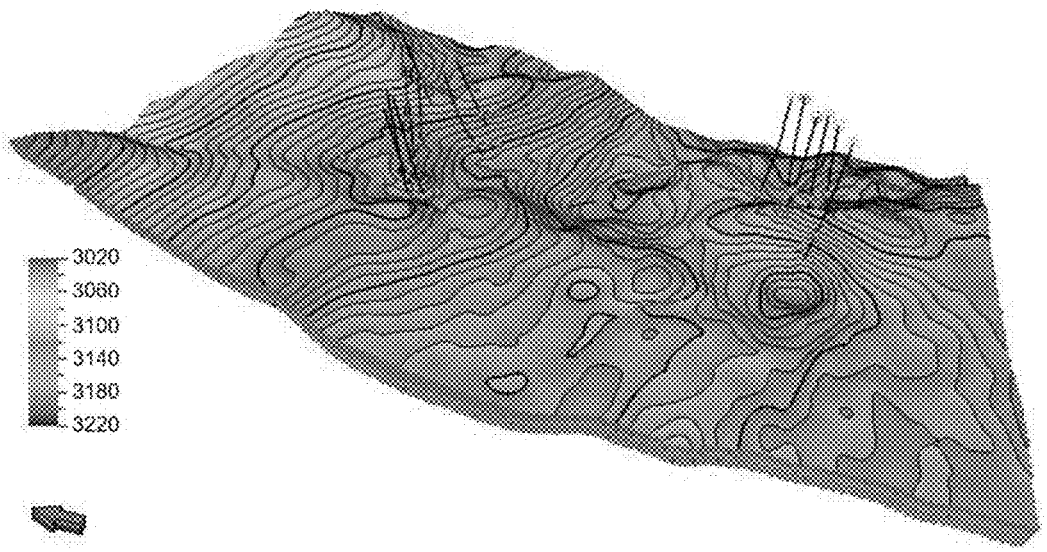
FIG. 36 is a diagram of a 3D mesh model of the main shale gas-producing layer in a certain area of western in China in an example.

Structural distribution models (FIG. 32, FIG. 33, FIG. 34 and FIG. 35) for top and bottom surfaces of respective small layers are established by using structural distribution models of top surfaces of the respective small layers obtained in a) and b) as an input, and the elevation data set of the top surfaces of the corresponding small layers as a hard constraint by means of a multiple mesh approximation principle under the condition of ensuring that the residual at each data point of the elevation data set is zero. Finally, the establishment of a 3D mesh model (FIG. 36) of a main layer group of the shale formation is completed in conjunction with 3D tomographic modeling results, thereby realizing the in-situ characterization of the spatial location distribution of each small layer encountered in tight oil and gas reservoirs in vertical and horizontal wells by using a 3D mesh model.

(3) 3D in-situ visualized characterization of the shale generating and reserving performance parameters is achieved based on lithofacies-well-seismic coupling.

S6: establishing a 3D visualized seismic-lithofacies dual-control parameter field of generating and reserving performance parameters of shale.

The parameters of the TOC content and porosity 3D model, which are predicted by seismic attributes, into the in-situ 3D mesh model of the shale formation respectively by using a deterministic assignment method, and a 3D model of the seismic attributes of the in-situ TOC content and porosity of the shale formation is established. A 3D lithofacies model is established with result data of single-entry lithofacies analysis as a main input according to a principle sequential indicator or truncated Gaussian method based on a principle that is closest to the logging interpretation lithofacies statistics. A seismic-lithofacies dual-control parameter field with 3D visualization of the TOC content and porosity of shale is formed.

FIG. 20 and FIG. 21 show in-situ TOC content and porosity seismic attribute 3D mesh models of a main shale gas-producing layer of Wufeng-Longmaxi group in a certain area of western in China, which are established by predicting the TOC content and porosity by using 3D seismic body attributes based on a well-seismic coupling self-feedback neural network method and assigning the predicted TOC content and porosity parameters into an in-situ 3D mesh model of the shale formation established based on well-seismic coupling.

Figure 37:
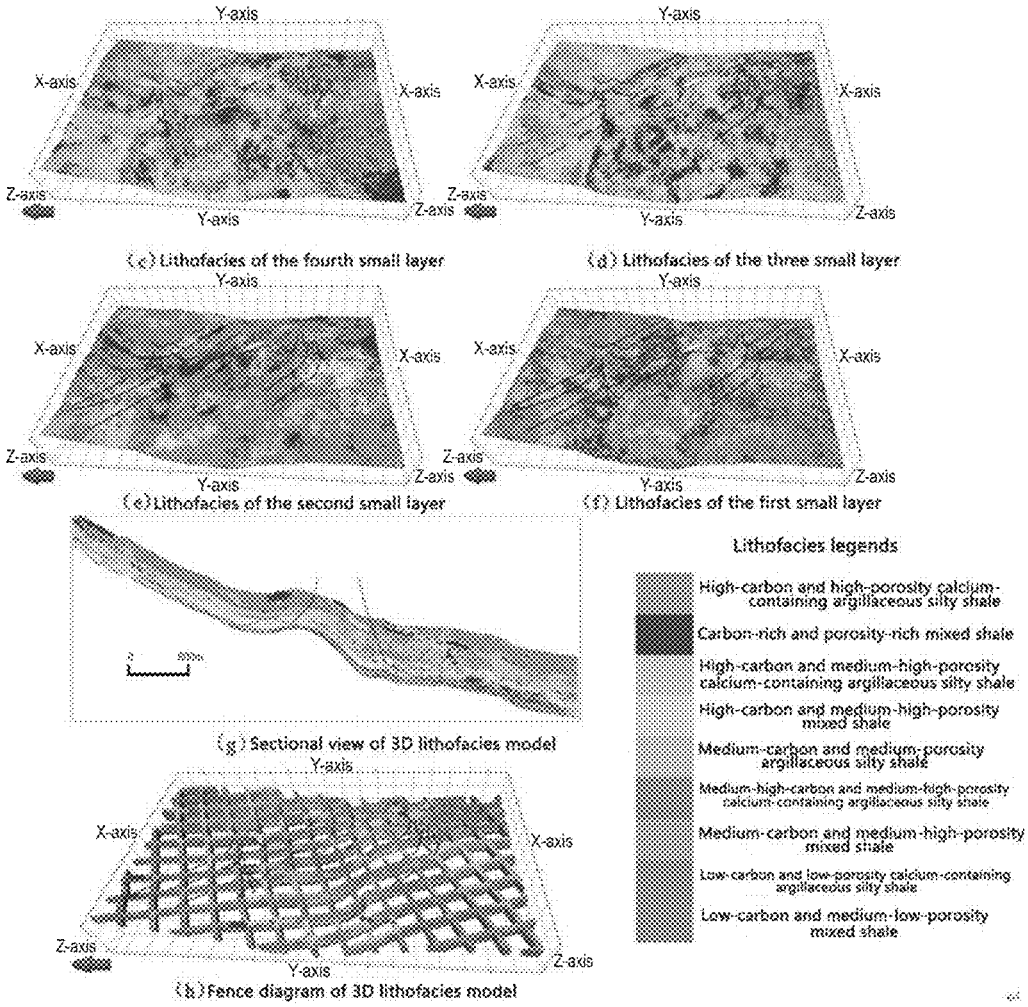
FIG. 37 is a 3D model distribution diagram of shale lithofacies in the main shale gas-producing layer in a certain area of western in China in an example.

FIG. 37 shows a 3D lithofacies model established by the sequential indicator method based on the single-well lithofacies analysis result data of the main shale gas-producing layer of Wufeng-Longmaxi group in a certain area of western in China.

The results shown in FIG. 20, FIG. 21, and FIG. 37 have formed a 3D visualized seismic-lithofacies dual-control parameter field of the TOC content and porosity of the main shale gas-producing layer of Wufeng-Longmaxi group in a certain area in western of China.

S7: Implementing 3D in-situ visualized characterization of the shale generating and reserving performance parameters based on lithofacies-well-seismic coupling.

Single-well point-by-point data of the TOC content and porosity completed on the basis of lithofacies-well coupling is coarsened into an in-situ 3D mesh model of small layers of shale established on the basis of well-seismic coupling, to form a main input of 3D visualization modeling; and the seismic-lithofacies dual-control parameter field is coupled to the logging TOC and porosity by taking TOC and porosity statistics of various lithofacies in a 3D space of a lithofacies model as constraints, taking a 3D mesh model of seismic attributes of the TOC content and porosity as changing trends, and using a simulation method of combining sequential Gaussian with co-kriging, thereby realizing the 3D in-situ characterization of the spatial heterogeneity characteristics of the TOC content and porosity of shale based on lithofacies-well-seismic coupling.

Figure 38:
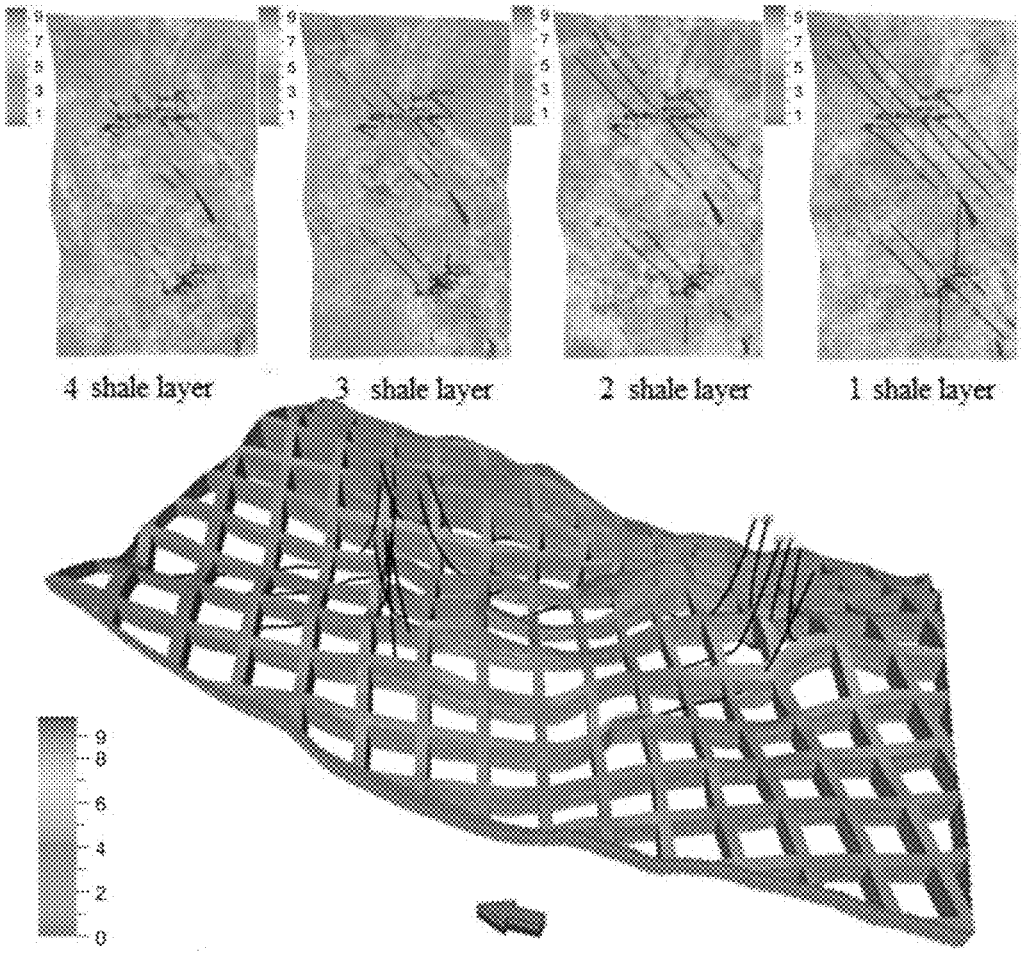
FIG. 38 is a 3D model distribution diagram of the TOC content of shale gas in the main shale gas-producing layer in a certain area of western in China in an example.

Single-well point-by-point data of the TOC content of the main shale gas-producing layer of Wufeng-Longmaxi group in a certain area of the western in China is coarsened into the in-situ 3D mesh model of the shale formation established on the basis of well-seismic coupling, to form a main input of 3D visualization modeling. A seismic-lithofacies dual-control parameter field is coupled to the logging TOC by taking TOC statistics of various lithofacies in a 3D space of the lithofacies model of the main shale gas-producing layer of Wufeng-Longmaxi group in a certain area in western of China as constraints, taking a 3D mesh model of seismic attributes of the TOC content as changing trends, and using a simulation method of combining sequential Gaussian with co-kriging, to establish a 3D mode (FIG. 38) of the TOC content of the main shale gas-producing layer of Wufeng-Longmaxi group in a certain area in western of China, thereby realizing the 3D in-situ characterization of the spatial heterogeneity characteristics of the TOC content of shale based on lithofacies-well-seismic coupling.

Figure 39:
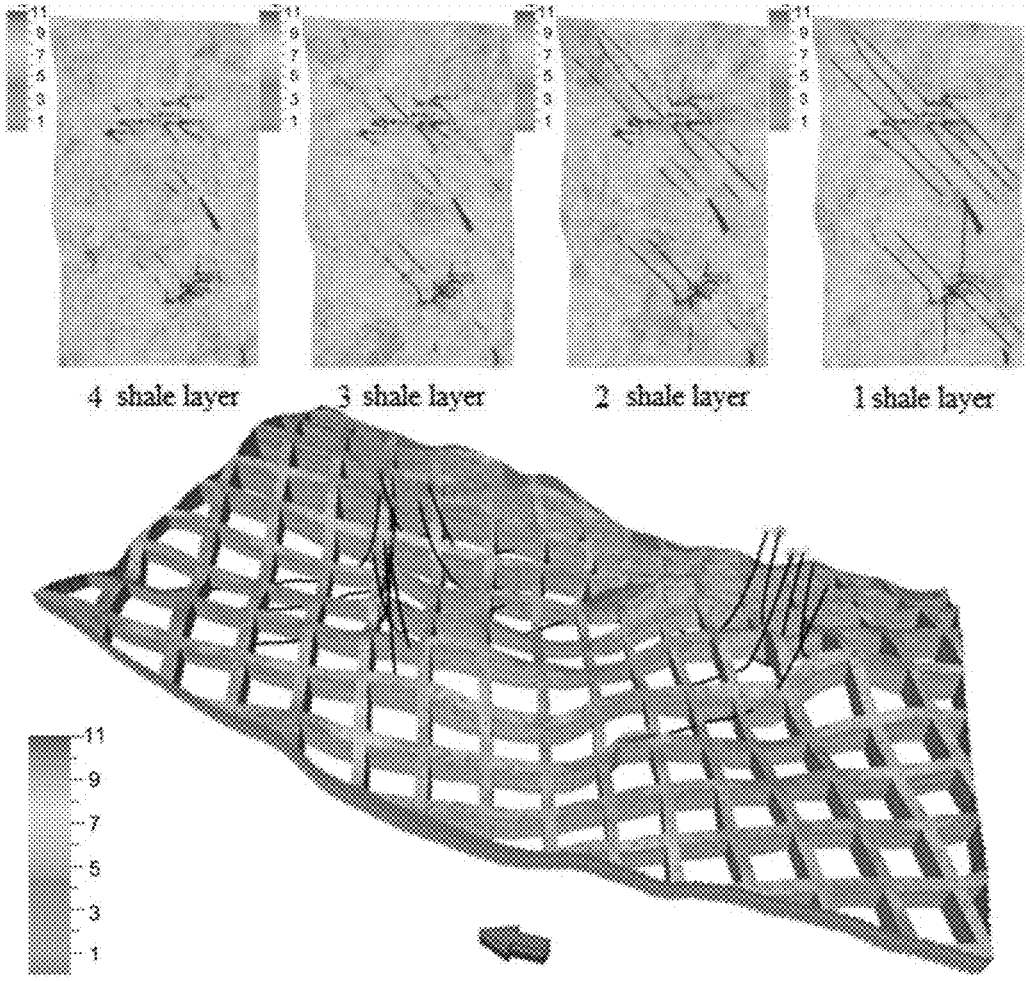
FIG. 39 is a 3D model distribution diagram of the porosity of shale gas in the main shale gas-producing layer in a certain area of western in China in an example.

Single-well point-by-point data of the porosity of the main shale gas-producing layer of Wufeng-Longmaxi group in a certain area of the western in China is coarsened into an in-situ 3D mesh model of the shale formation established on the basis of well-seismic coupling, to form a main input of 3D visualization modeling. A seismic-lithofacies dual-control parameter field is coupled to the logging porosity by taking porosity statistics of various lithofacies in a 3D space of the lithofacies model of the main shale gas-producing layer of Wufeng-Longmaxi group in a certain area in western of China as constraints, taking a 3D mesh model of seismic attributes of the porosity as changing trends, and using a simulation method of combining sequential Gaussian with co-kriging, to establish a 3D model (FIG. 39) of the porosity of the main shale gas-producing layer of Wufeng-Longmaxi group in a certain area in western of China, thereby realizing the 3D in-situ characterization of the spatial heterogeneity characteristics of the porosity of shale based on lithofacies-well-seismic coupling.

The present invention has the following beneficial effects: by integrating an in-situ technology into shale logging, seismic generating and reserving parameter interpretation, and the establishment of a 3D mesh model of small layers of shale, a supporting technical method for in-situ interpretation of shale generating and reserving performance parameters-shale small-layer framework spatial in-situ modeling-in-situ 3D visualization of heterogeneity in shale generating and reserving performance parameters is established, which realizes the accurate description of the heterogeneity in TOC content and porosity value of shale oil and gas in a 3D space, and provides a reliable technical support for shale oil and gas exploration and development.

The basic principles and main features of the present invention and the advantages of the present invention have been shown and described above. Those skilled in the art should understand that the present invention is not limited by the above-mentioned embodiments. The foregoing embodiments and descriptions described in the specification only illustrate the principle of the present invention. Without departing from the spirit and scope of the present invention, the present invention will have various changes and improvements, and these changes and improvements shall fall into the claimed invention. The protection scope of the present invention is defined by the appended claims and their equivalents.

The invention claimed is:

1. A three-dimensional in-situ characterization method for heterogeneity in generating and reserving performances of shale, to overcome the technical problem that most of the total organic carbon (TOC) content and porosity value logging interpretation in the prior art is directly derived from the matching of core data and logging data, lack of big data mining process between core data and logging data, which leads to a large error between the logging interpretation results and the actual TOC content and porosity values of shale layer, and with the purpose of achieving accurate characterization of the heterogeneity of TOC content and porosity values of shale oil gas in 3D space and providing reliable technical support for shale oil exploration and development, comprising the following steps:

S1: establishing a logging in-situ interpretation model of generating and reserving parameters based on lithofacies-lithofacies-well coupling, and completing point-by-point interpretation of generating and reserving parameters of a single well, wherein the S1 specifically comprises the following sub-steps:

S101: returning the TOC and porosity value obtained by a core test to an in-situ drilling depth by core location, extracting curve values of conventional logging series at the same depth, mining a relationship between the TOC and the conventional logging series and a relationship between the porosity and the conventional logging series by using a classification regression tree algorithm, and determining a sensitive logging curve for the TOC and the porosity;

S102: establishing a TOC and porosity calculation model for the sensitive logging curve by using a multiple regression method, and completing single-well point-by-point calculation of the TOC and the porosity; counting the TOC and the porosity value of each type of shale lithofacies by using a shale lithofacies mode established on the basis of core descriptions; extracting the statistics of the TOC and porosity value of each type of shale lithofacies, establishing a TOC and porosity calculation model by merging the statistics, and forming a logging interpretation model for generating and reserving performance parameters of shale; and S103: based on the statistics of the TOC and porosity value of each type of shale lithofacies, correcting and perfecting single-well point-by-point calculation results of the TOC and porosity value on the basis of single-well lithofacies analysis results, to complete the single-well point-by-point interpretation of the TOC and porosity value;

S2: establishing an optimal well-seismic coupling interpretation model that characterizes the TOC content and porosity of a shale formation based on well-seismic coupling;

S3: completing the establishment of a structural distribution model of top and bottom surfaces of a layer group based on lithofacies-electrical facies of vertical well-seismic coupling, thereby forming an in-situ spatial framework of the layer group;

S4: establishing a structural distribution model of top and bottom surfaces of small layers based on a vertical well by using 3D visualization comparison of the vertical well, thereby forming a spatial distribution trend framework of small layers of the shale formation;

S5: establishing a structural distribution model of top and bottom surfaces of small layers based on vertical well+horizontal well by using 3D visualization comparison of the horizontal well, thereby forming an in-situ three-dimensional mesh model of the small layers of the shale formation;

S6: establishing a three-dimensional model and a lithofacies model of seismic attributes of in-situ TOC content and porosity of the shale formation, thereby forming a three-dimensional visualized seismic-lithofacies dual-control parameter field of generating and reserving performance parameters of shale; and S7: coarsening single-well point-by-point data of the TOC content and porosity completed on the basis of lithofacies-lithofacies-well coupling into an in-situ three-dimensional mesh model of the small layers of shale, to form a main input of three-dimensional visualization modeling; coupling the seismic-lithofacies dual-control parameter field to the logging TOC and porosity by taking TOC and porosity statistics of various lithofacies in a three-dimensional space of a lithofacies model as constraints, taking a three-dimensional model of seismic attributes of the TOC content and porosity as a changing trend, and using a simulation method of combining sequential Gaussian with co-kriging, thereby realizing the three-dimensional in-situ characterization of the spatial heterogeneity characteristics of the TOC content and porosity of shale.

2. The three-dimensional in-situ characterization method for heterogeneity in generating and reserving performances of shale according to claim 1, wherein the sensitive logging curves for the TOC and porosity include a natural gamma GR logging curve, a sonic time difference AC logging curve, a compensated neutron CNL logging curve, a compensated density DEN logging curve and a deep lateral resistivity RT logging curve.

3. The three-dimensional in-situ characterization method for heterogeneity in generating and reserving performances of shale according to claim 1, wherein the S2 specifically comprises the following sub-steps:

S201: extracting 3D seismic body attributes from modeling software;

S202: preliminarily screening seismic body attribute types that can be used to express the TOC content and porosity of a shale formation according to an original geological meaning of seismic body attributes, judging the independence of the screened seismic body attributes by using a R-type factor analysis method, and eliminating the seismic body attributes with high correlation to obtain preferred seismic body attributes that express the TOC content and porosity value of the shale formation; and S203: establishing an optimal well-seismic coupling interpretation model that characterizes the TOC content and porosity of the shale formation by using well-seismic coupling and adopting a single attribute linear regression method, a multi-attribute nested combination analysis method and a self-feedback neural network method respectively.

4. The three-dimensional in-situ characterization method for heterogeneity in generating and reserving performances of shale according to claim 1, wherein the S3 specifically comprises the following sub-steps:

S301: establishing an in-situ layering model of lithofacies-electrical facies coupling for top and bottom surfaces of a layer group and an interface of each small layer in the layer group based on lithofacies characteristics of a vertical well under exploration evaluation, and characteristics of a lithology indicator curve, a porosity indicator curve, or an oil-gas-bearing indicator curve, to form an in-situ spatial framework of the top and bottom surfaces of the layer group and interfaces of the small layers in the layer group at the location of a drilling well point;

S302: establishing a time-depth conversion relationship by using a synthetic recording method, and projecting in-situ depth information of the top and bottom surfaces of the layer group identified by the vertical well under exploration evaluation onto a seismic-time profile to form a well-seismic coupling relationship of top and bottom interfaces of a main oil-producing layer group of the shale formation; and S303: converting time data of the top and bottom surfaces of the layer group into depth data by using the established time-depth conversion relationship; completing the establishment of a structural distribution model of the top and bottom surfaces of the layer group under the condition of ensuring that a residual at the vertical well point under exploration evaluation is zero by means of a multiple mesh approximation algorithm by using the depth data as a main input, and elevation data of the vertical well point under exploration evaluation as a hard constraint condition, and forming a spatial in-situ framework of the layer group of the shale formation.

5. The three-dimensional in-situ characterization method for heterogeneity in generating and reserving performances of shale according to claim 1, wherein the S4 comprises the following sub-steps:

S401: carrying out three-dimensional visualized comparison of small layers of the vertical well according to an in-situ layering mode of lithofacies-electric facies coupling for interfaces of respective small layers in the layer group, extracting the elevation data of the top and bottom surfaces of the small layers at each vertical well position, and establishing a small layer framework in the layer group; and S402: establishing a structural distribution model of the top and bottom surfaces of small layers according to a position proximity principle by selecting a structural distribution model of top and bottom surfaces of the layer group close to the top and bottom surfaces of the small layers as a main input, and the elevation data of the top and bottom surfaces of each small layer as a hard constraint by means of a multiple mesh approximation principle under the condition of ensuring that the residual at the vertical well point is zero, and forming a spatial distribution trend framework of the small layers of the shale formation.

6. The three-dimensional in-situ characterization method for heterogeneity in generating and reserving performances of shale according to claim 1, wherein the S5 specifically comprises the following sub-steps:

S501: carrying out three-dimensional visualized comparison of a horizontal well according to an in-situ layering mode of lithofacies-electric facies coupling of interfaces of respective small layers in the layer group, and determining a relationship between a horizontal well trajectory and top and bottom interfaces of a target small layer; and S502: quantitatively characterizing the target small layer along the horizontal well trajectory and the top and bottom interface positions of each small layer adjacent to the target small layer, extracting position elevation data to form elevation data of the top and bottom surfaces of the small layers of the horizontal well, and merging the elevation data with the elevation data of the top and bottom surfaces of the small layer at the vertical well position into a new data set; and establishing a new structural distribution model of top and bottom surfaces of small layers based on vertical well+horizontal well by using the previously established structural distribution model of the top and bottom surfaces of the small layers as a trend constraint, to finally form an in-situ three-dimensional mesh model of the small layers of shale.

7. The three-dimensional in-situ characterization method for heterogeneity in generating and reserving performances of shale according to claim 1, wherein the S6 comprises the following sub-steps:

S601: assigning parameters of the TOC content and porosity 3D model, which are predicted by seismic attributes, into the in-situ 3D mesh model of the small layers of shale respectively by using a deterministic assignment method, and establishing a three-dimensional model of the seismic attributes of the in-situ TOC content and porosity of the shale formation; and S602: establishing a lithofacies model with result data of single-entry lithofacies analysis as a main input according to a principle sequential indicator or truncated Gaussian method, and forming a seismic-lithofacies dual-control parameter field with three-dimensional visualization of the TOC content and porosity of shale.

* * * * *